US008051503B2

(12) United States Patent
Nguyen et al.

(10) Patent No.: US 8,051,503 B2
(45) Date of Patent: Nov. 8, 2011

(54) DISPENSING DEVICE

(75) Inventors: Lamson Nguyen, Somerset, NJ (US); Steven Wu, Montvale, NJ (US)

(73) Assignee: Reckitt Benckiser LLC, Parsippany, NJ (US)

( * ) Notice: Subject to any disclaimer, the term of this patent is extended or adjusted under 35 U.S.C. 154(b) by 1313 days.

(21) Appl. No.: 11/573,141

(22) PCT Filed: Jul. 19, 2005

(86) PCT No.: PCT/GB2005/002831

§ 371 (c)(1),
(2), (4) Date: Feb. 2, 2007

(87) PCT Pub. No.: WO2006/013321

PCT Pub. Date: Feb. 9, 2006

(65) Prior Publication Data

US 2007/0245470 A1 Oct. 25, 2007

(30) Foreign Application Priority Data

Aug. 4, 2004 (GB) ..... 0417360.5
Jan. 19, 2005 (GB) ..... 0501038.4

(51) Int. Cl.
*E03D 9/02* (2006.01)

(52) U.S. Cl. ..... 4/223

(58) Field of Classification Search ..... 4/223, 227.1, 4/227.4, 227.5, 231
See application file for complete search history.

(56) References Cited

U.S. PATENT DOCUMENTS 927,132 A 7/1909 Duenwald
1,067,472 A 7/1913 Creed
1,070,108 A 8/1913 Brittain
1,091,265 A 3/1914 Wohlander
1,113,959 A 10/1914 Danks
1,130,681 A 3/1915 Albertson
1,145,669 A 7/1915 Brown
1,359,535 A 11/1920 Runser
1,411,218 A 3/1922 Markowski
1,974,955 A 9/1934 Foltis
4,143,431 A 3/1979 Goncalves
4,432,102 A 2/1984 Woodruff et al.
4,460,490 A 7/1984 Barford et al.
4,537,897 A 8/1985 Tessier et al.

(Continued)

FOREIGN PATENT DOCUMENTS

DE 3817373 A1 11/1989

(Continued)

OTHER PUBLICATIONS

International Search Report dated Sep. 20, 2005 for application PCT/GB2005/002831.

(Continued)

*Primary Examiner* — Huyen Le

(74) *Attorney, Agent, or Firm* — Norris McLaughlin & Marcus, PA

(57) ABSTRACT

A device useful for the delivery of a treatment composition, and a fragrancing effect to a sanitary appliance, especially a toilet bowl, the device (10) comprising a dispenser body (200) comprising a body cavity (27) for the treatment composition; at least one inlet (28) and at least one outlet (28); at least one fragrance cavity (31,32); and a hanger (42)for hanging the device upon a portion of a sanitary appliance.

17 Claims, 11 Drawing Sheets

U.S. PATENT DOCUMENTS

| | | | | |
|---|---|---|---|---|
| 4,555,819 | A | 12/1985 | Weiss et al. | |
| 4,560,766 | A | 12/1985 | Girard et al. | |
| 4,564,424 | A | 1/1986 | Cassat et al. | |
| 4,578,207 | A | 3/1986 | Holdt et al. | |
| 5,759,974 | A | 6/1998 | Menke et al. | |
| 5,780,527 | A | 7/1998 | O'Leary | |
| 6,766,817 | B2 | 7/2004 | da Silva | |
| 6,918,404 | B2 | 7/2005 | Dias da Silva | |
| 7,066,586 | B2 | 6/2006 | da Silva | |
| 7,832,025 | B2 * | 11/2010 | Virica et al. | 4/227.4 |

FOREIGN PATENT DOCUMENTS

| | | | |
|---|---|---|---|
| DE | 60031956 | T2 | 9/2007 |
| FR | 2457347 | | 3/1980 |
| GB | 11185 | | 0/1913 |
| GB | 13423 | | 0/1910 |
| GB | 2194258 | A | 3/1988 |
| GB | 2346904 | A | 11/2000 |
| GB | 2368854 | A | 5/2002 |
| WO | 9845543 | | 10/1998 |
| WO | 03027405 | A1 | 4/2003 |
| WO | 03/042462 | A2 | 5/2003 |
| WO | 03042462 | A2 | 5/2003 |
| WO | 2004/001145 | A1 | 12/2003 |
| WO | 2004001145 | A1 | 12/2003 |
| WO | 2005/001212 | A1 | 1/2005 |
| WO | 2005001212 | A1 | 1/2005 |

OTHER PUBLICATIONS

Written Opinion of the International Searching Authority for application PCT/GB2005/002831, dated Oct. 5, 2005.

International Preliminary Report on Patentability dated Sep. 19, 2006 for application PCT/GB2005/002831.

Combined Search and Examination Report issued by The Patent Office in Great Britain for application GB0417360.5 and dated Jan. 6, 2005.

Combined Search and Examination Report issued by The Patent Office in Great Britain for application GB0501038.4 and dated May 18, 2005.

Response to Written Opinion dated Jun. 1, 2006.

English Language Abstract for DE60031956 taken from esp@cenet.com, dated Sep. 20, 2007.

English Language Abstract for DE3817373 taken from esp@cenet.com, dated Nov. 39, 1989.

English Language Abstract for FR2457347 taken from esp@cenet.com, dated Dec. 19, 1980.

* cited by examiner

DISPENSING DEVICE

This application is filed under 35 USC 371 of PCT/GB2005/002831.

The present invention is related to devices which are useful in dispensing a treatment composition (e.g, cleaning and/or sanitizing and/or coloring composition) to a sanitary appliance, e.g., a toilet bowl, while simultaneously dispensing a fragrance or perfume to the ambient environment outside of the sanitary appliance.

Since the advent of sanitary appliances, there has been a continuing need in the art to provide effective ways to maintain these appliances in a satisfactory condition between uses. The art is replete with devices which are intended to be used as "in the bowl" (or ITB) or "in the cistern" (or ITC) in order to provide a coloring and/or cleaning and/or fragrancing and/or sanitizing effect to such sanitary devices, particularly toilet bowls. While many of these devices are known and widely used they are not without drawbacks. One common technical problem is to ensure the effective delivery of a treatment agent, especially a coloring agent and/or a cleaning and/or a sanitizing agent to the interior of a toilet, while at the same time providing a fragrancing effect in the proximity of the toilet. One common approach known to the art is to provide a device which is suspended from the rim of the toilet bowl and which is placed at or near the interior sidewall of the toilet bowl. Such a device is designed to typically dispense a treatment composition to the interior of a toilet typically when contacted with flushing water, or alternately, it dispenses a fragrancing composition to the toilet bowl which is intended to counteract or mask malodors. Certain known arts devices can provide these effects simultaneously, however they are frequently limited in their application due to the requirements of chemical compatibility between several chemical compositions which are needed in order to provide these different treatment effects. Such chemical compatibility requirements curtail the range of possible treatment compositions which may be simultaneously used.

Thus, while certain known-art dispensing devices provide beneficial treatment effects, there is nonetheless a real and continuing need in the art to provide improved devices which can simultaneously provide to a sanitary appliance, e.g., a toilet bowl, while simultaneously dispensing a fragrance or perfume to the ambient environment outside of the sanitary appliance without the necessity of ensuring chemical compatibility between the fragrancing composition and the one or more treatment compositions present in the device.

The present invention, in its various aspects, provides a device useful for the delivery of at least one treatment composition, optionally but often desirably simultaneously with at least one fragrancing composition to a sanitary appliance, e.g. a toilet bowl. The device can be used either as an ITC type device, or an ITB type device for a toilet bowl, but is preferably used as an ITB type device.

According to a first aspect of the invention there is provided a dispensing device useful in conjunction with a toilet bowl or other sanitary appliance which device provides for the delivery of at least one treatment composition preferably at least one treatment composition selected from: coloring compositions, cleaning compositions, bleaching compositions, disinfecting compositions, anti-limescale compositions to a portion of a sanitary appliance, while simultaneously optionally but desirably providing a fragrancing effect to the ambient environment of the sanitary appliance as well, wherein the device includes:

(a) a dispenser body comprising at least one body cavity adapted to contain at least one chemical composition preferably selected from: coloring compositions, cleaning compositions, bleaching compositions, disinfecting compositions, and anti-limescale compositions; at least one inlet to permit for passage of water contained within the sanitary appliance to pass into the body cavity and contact the at least one chemical composition and; at least one outlet to permit for the egress of a treatment composition from the body cavity; and at least one fragrance cavity adapted to contain a quantity of a fragrance composition;

(b) a hanger which may depend from any part of the device which hanger is adapted for removably hanging the device upon a portion of a sanitary appliance.

According to a second aspect of the invention there is provided a dispensing device useful in conjunction with a toilet bowl or other sanitary appliance which device provides for the delivery of at least one treatment composition preferably at least one treatment composition selected from: coloring compositions, cleaning compositions, bleaching compositions and disinfecting compositions, anti-limescale compositions to a portion of a sanitary appliance, while optionally but desirably simultaneously providing a fragrancing effect to the ambient environment of the sanitary appliance as well, wherein the device includes:

(a) a dispenser body comprising a body cavity adapted to contain at least one chemical composition preferably selected from: coloring compositions, cleaning compositions, bleaching compositions and disinfecting compositions, and anti-limescale compositions; at least one inlet to permit for passage of water contained within the sanitary appliance to pass into the body cavity and contact the at least one chemical composition and; at least one outlet to permit for the egress of a treatment composition from the body cavity; and at least two fragrance cavities adapted to contain a quantity of a fragrance composition;

(b) a hanger which may depend from any part of the device which hanger is adapted for removably hanging the device upon a portion of a sanitary appliance.

According to a third aspect of the invention there is provided a dispensing device useful in conjunction with a toilet bowl or other sanitary appliance which device provides for the delivery of at least one treatment composition preferably at least one treatment composition selected from: coloring compositions, cleaning compositions, bleaching compositions and disinfecting compositions, anti-limescale compositions to a portion of a sanitary appliance, while optionally but desirably simultaneously providing a fragrancing effect to the ambient environment of the sanitary appliance as well, wherein the device includes:

(a) a dispenser body comprising a body cavity adapted to contain at least one chemical composition preferably selected from: coloring compositions, cleaning compositions, bleaching compositions and disinfecting compositions, and anti-limescale compositions; at least one inlet to permit for passage of water contained within the sanitary appliance to pass into the body cavity and contact the at least one chemical composition and; at least one outlet to permit for the egress of a treatment composition from the body cavity; and (b) a hanger which may depend from any part of the device which includes at least one fragrance cavities adapted to contain a quantity of a fragrance composition, which hanger is adapted for removably hanging the device upon a portion of a sanitary appliance.

According to a fourth aspect of the invention there is provided a dispensing device according to any of the previous aspects of the invention wherein the dispenser body has a maximum overall length dimension "L" and a maximum width dimension "W" measured in a plane perpendicularly intersecting "L" wherein the value of "L" to the value of "W" is at least 2×W, preferably is at least 2.5×W, yet more is at least 3×W. still more preferably is at least 3.5×W, especially preferably is at least is at least 4×W. yet more preferably is at least 4.5×W, still more preferably is at least 5×W, and most preferably is at least 7×W. However, the maximum overall length dimension "L" does not exceed 20×W.

According to a fifth aspect of the invention there is provided a dispensing device according to the any previous aspect of the invention wherein the first dispenser body contains at least one chemical composition in the body cavity, and further contains a fragrance composition within the fragrance cavity.

According to a sixth aspect of the invention there is provided a dispensing device according to any previous aspect of the invention wherein there is present one chemical composition contained in the dispenser body.

According to a seventh aspect of the invention there is provided a dispensing device according to any previous aspect of the invention wherein there is present at least two chemical compositions contained in the dispenser body.

According to eighth aspect of the invention there is provided a dispensing device according to any prior described aspect of the invention wherein the dispenser body is flexible.

According to a ninth aspect of the invention there is provided a dispensing device according to any prior described aspect of the invention wherein the hanger includes a secondary fragrance carrier.

In a further aspect of the present invention there is provided a process for the delivery of at least one treatment composition to the interior of a sanitary appliance, particularly a toilet bowl, which process contemplates providing a dispensing device as described hereinabove, installing the device within or upon at least a portion of a sanitary appliance, particularly a toilet bowl, such that the at least one chemical composition contained within the sanitary appliance contacts water and forms a treatment composition used for treating the sanitary appliance, while optionally but desirably simultaneously providing a fragrancing effect to ambient environment of the sanitary appliance.

In a yet further aspect, the present invention provides a process for the manufacture of dispensing devices as described herein.

These and still further aspects of the invention will become more apparent from the following detailed description of the invention, and accompanying drawings.

Figure 1:
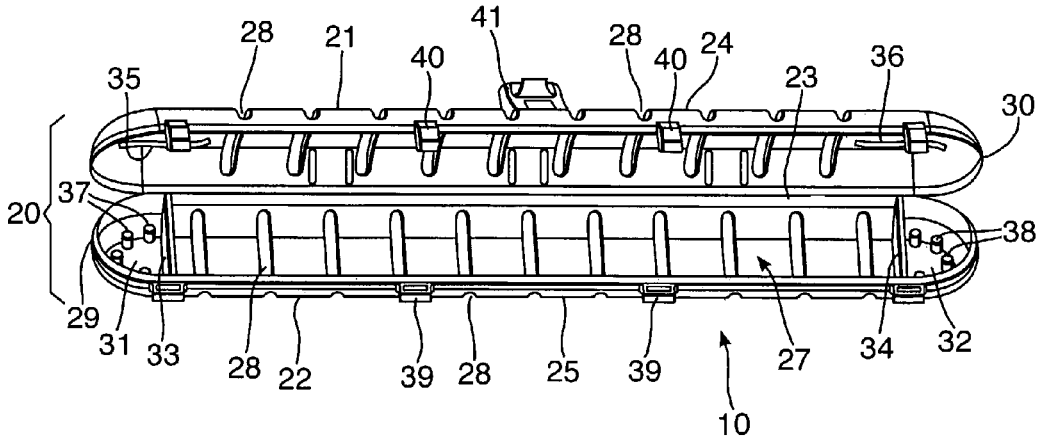
FIG. 1 illustrates a perspective frontal view of a dispenser body of a dispensing device according to the invention.

The device according to the invention is used to simultaneously deliver a treatment composition from a dispenser body to a surface of a sanitary appliance, which treatment composition contains one or more active chemical agents e.g., coloring agents, cleaning agents, disinfecting agents, anti-lime scale agents, or is a mixture of two or more active chemical agents, while optionally but desirably simultaneously providing a fragrancing effect from the device to the ambient environment of the sanitary appliance. A treatment composition is formed by the flow of water passing through the device coming into contact with a chemical composition contained within dispenser body.

Both the chemical composition, as well as the fragrance composition may be in provided to the device in any physical form, e.g., in a liquid, gel or solid form. Conveniently however, the chemical composition is in a gel form or is in a solid form, such as in the form of dissolvable block or dissolvable pellets or particles which provides for the long term release of an active agent during sequential contacts with water entering and exiting the first housing of the device. Conveniently and most preferably the fragrancing composition, when present, is provided in a gel form.

The chemical composition may include any known art cleaning agents or cleaning constituents known to those of ordinary skill in the relevant art, and without limitation include one or more detersive surfactants selected from anionic, cationic, nonionic as well as amphoteric or zwitterionic surfactants. Certain detersive surfactants may also provide a dual role in providing detergency as well as a disinfecting effect, viz, certain cationic surfactants, which are described hereinafter as a disinfecting agent. These one or more cleaning agents or cleaning constituents may be used with or without other constituents being present in the chemical compositions of the invention.

By way of non-limiting example, useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$-$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain. Exemplary useful are linear straight chain alkylbenzene sulfonates in which the average number of carbon atoms in the alkyl group is from about 11 to 14.

Further exemplary useful anionic surfactants herein are the water soluble salts of: paraffin sulfonates containing from about 8 to about 24 (preferably about 12 to 18) carbon atoms; alkyl glyeryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Still further exemplary useful anionic surfactants herein include the water soluble salts of esters of α-sulfonated fatty acids containing from about 0 to 20 carbon atoms in the fatty acid group and from about 1 to 10 carbon atoms in the ester group; water soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

A further class of anionic surfactants which may be used include carboxylates such as alkyl carboxylates which include those which may be represented by the general formula:

$$R—COO^-M^+$$

wherein R is a straight or branched hydrocarbon chain containing from about 9 to 21 carbon atoms, and M is a metal or ammonium ion; polyalkoxycarboxylates, representative of which are polyethoxycarboxylates which may be represented by the general formula:

$$R—[—OCH_2CH_2—]_n—CH_2COO^-M+$$

wherein R is a straight chained or branched hydrocarbon chain which may include an aryl moiety, but is desirably a straight chained or branched hydrocarbon chain; and n is an integer value of from 1-24.

Preferred anionic surfactants are those anionic surfactants typically used in toilet cleaning compositions. Examples include sulfonates, sulfates, carboxylates, phosphates, and mixtures of the above compounds. Suitable cations in this case are alkali metals such as, for example, sodium or potassium, or alkaline earth metals such as, for example, calcium or magnesium, and ammonium, substituted ammonium compounds, including mono-, di- or triethanolammonium cations and mixtures of the cations. The following types of anionic surfactants are of particular interest: alkyl ester sulfonates, alkylsulfates, alkyl ether sulfates, alkylaryl sulfates and sulfonates, and secondary alkanesulfonates, alkenyl sulfonates. Examples of suitable anionic surfactants include alpha olefin sulfonates, dodecylbenzene sulfonates, lauryl ether sulfates, lauryl monethanol amides.

Exemplary nonionic surfactants which may find use in the present invention include known art nonionic surfactant compounds. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic surfactant compound. Further, the length of the polyethylenoxy hydrophobic and hydrophilic elements may various. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

A particularly useful class of nonionic surfactants include alkoxy block copolymers which include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO\text{-}(EO)_x(PO_y(EO)_z—H \quad (A)$$

where EO represents ethylene oxide,

PO represents propylene oxide, y equals at least 15, $(EO)_{x+z}$ equals 20 to 80% of the total weight of said compounds, and, the total molecular weight is preferably in the range of about 2000 to 15,000.

Another group of nonionic surfactants appropriate for use in the new compositions can be represented by the formula (B):

$$R\text{-}(EO,PO)_a(EO,PO)_b—H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000. Still further useful nonionic surfactants containing polymeric butoxy (BO) groups can be represented by formula (C) as follows:

$$RO—(BO)_n(EO)_x—H \quad (C)$$

wherein R is an alkyl group containing 1 to 20 carbon atoms, n is about 5-15 and x is about 5-15.

Also useful as the nonionic block copolymer surfactants, which also include polymeric butoxy groups, are those which may be represented by the following formula (D) as follows:

$$HO\text{-}(EO)_x(BO)_n(EO)_y—H \quad (D)$$

wherein n is about 5-15, preferably about 15, x is about 5-15, preferably about 15, and y is about 5-15, preferably about 15.

Still further useful nonionic block copolymer surfactants include ethoxylated derivatives of propoxylated ethylene diamine, which may be represented by the following formula:

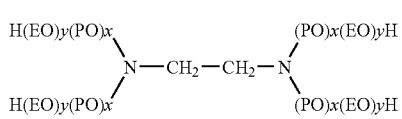

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Further exemplary useful nonionic surfactants which may be used in the present invention include certain alkanolamides including monoethanolamides and diethanolamides, particularly fatty monoalkanolamides and fatty dialkanolamides. Commercially available monoethanol amides and diethanol amides include those marketed under the trade names Alakamide® and Cyclomide® by Rhône-Poulenc Co., (Cranbury, N.J.).

Preferred nonionic surfactants which may be used are those selected from primary and secondary alcohol ethoxylates and alkoxy block copolymers based on ethylene oxide, propylene oxide, and/or butylene oxide and mixtures thereof. For the alcohol ethoxylates, the alkyl chain of the aliphatic alcohols can be linear or branched, primary or secondary, and generally contains from about 8 to about 22 carbon atoms. The alkyl chain can be saturated or unsaturated. The alcohol ethoxylates can have a narrow ("narrow range ethoxylates") or a broad ("broad range ethoxylates") homolog distribution of the ethylene oxide. Examples of commercially available nonionic surfactants of this type are available under the tradenames Tergitol®, Genapol®, and Neodol®. Preferably, the alcohol ethoxylates are mixed C9/11 or C11/15 alcohol ethoxylates, condensed with an average of from 6 to 15 moles, preferably from 6 to 12 moles, and most preferably from 6 to 9 moles of ethylene oxide per mole of alcohol. Preferably the ethoxylated nonionic surfactant so derived has a narrow ethoxylate distribution relative to the average.

Further particularly preferred nonionic surfactants which may be used are nonionic surfactants based on block copolymers represented by formula (A) specific examples of which include those materials presently commercially available under the tradename Pluronic® (ex. BASF). Of those of formula (A), block copolymers having an average molecular weight between 7000 to 11,000 are preferred. Examples of such components include Pluronic® 87, described as $EO_{61}$ $PO_{41.5}$ $EO_{61}$, having an average molecular weight of about 7700 and Pluronic® 88, described as $EO_{98}$ $PO_{41.5}$ $EO_{98}$, having an average molecular weight of about 10800.

Non-limiting examples of exemplary useful amphoteric surfactants include alkylbetaines, particularly those which may be represented by the following structural formula:

$$RN(CH_3)_2CH_2COO^-$$

wherein R is a straight or branched hydrocarbon chain which may include an aryl moiety, but is preferably a straight hydrocarbon chain containing from about 6 to 30 carbon atoms. Further exemplary useful amphoteric surfactants include amidoalkylbetaines, such as amidopropylbetaines which may be represented by the following structural formula:

$$RCONHCH_2CH_2CH_2N^+(CH_3)_2CH_2COO^-$$

wherein R is a straight or branched hydrocarbon chain which may include an aryl moiety, but is preferably a straight hydrocarbon chain containing from about 6 to 30 carbon atoms.

The chemical compositions of the invention may include one or more sanitizing agents or sanitizing constituents which may be used with or without other constituents being present in the chemical compositions of the invention.

The sanitizing agent can be any sanitizing composition known to those of ordinary skill in the relevant art, and without limitation exemplary sanitizing compositions include materials containing alkyl halohydantoins, alkali metal haloisocyanurates, essential oils, non-quaternary ammonium based germicidal compounds as well as quaternary ammonium germicidal compounds. These one or more sanitizing agents may be used with or without other constituents being present in the chemical compositions of the invention.

By way of non-limiting example, exemplary useful halohydantoins which may be used include those which may be represented by the general structure:

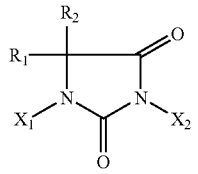

wherein:

$X_1$ and $X_2$ are independently hydrogen, chlorine or bromine; and, $R_1$ and $R_2$ are independently alkyl groups having from 1 to 6 carbon atoms.

Examples of halohydantoins include, for example, N,N'-dichloro-dimethyl-hydantoin, N-bromo-N-chloro-dimethylhydantoin, N,N'-dibromo-dimethyl-hydantoin, 1,4-dichloro, 5,5-dialkyl substituted hydantoin, wherein each alkyl group independently has 1 to 6 carbon atoms, N-monohalogenated hydantoins such as chlorodimethylhydantoin (MCDMH) and N-bromo-dimethylhydantoin (MBDMH); dihalogenated hydantoins such as dichlorodimethylhydantoin (DCDMH), dibromodimethylhydantoin (DBDMH), and 1-bromo-3-chloro-5,5,-dimethylhydantoin (BCDMH); and halogenated methylethylhydantoins such as chloromethylethylhydantion (MCMEH), dichloromethylethylhydantoin (DCMEH), bromomethylethylhydantoin (MBMEH), dibromomethylethylhydantoin (DBMEH), and bromochloromethylethylhydantoin (BCMEH), and mixtures thereof. These materials are more fully discussed in U.S. Pat. Nos. 4,560,766; 4,537,897; and 4,564,424, the contents of which are incorporated by reference.

Other germicidally effective agents useful as sanitizing agents include sodium dichloroisocyanurate (DCCNa) and sodium dibromoisocyanurate. Further examples of non-quaternary ammonium based sanitizing agents include pyrithiones, dimethyldimethylol hydantoin, methylchloroisothiazolinone/methylisothiazolinone sodium sulfite, sodium bisulfite, imidazolidinyl urea, diazolidinyl urea, benzyl alcohol, 2-bromo-2-nitropropane-1,3-diol, formalin (formaldehyde), iodopropenyl butylcarbamate, chloroacetamide, methanamine, methyldibromonitrile glutaronitrile, glutaraldehyde, 5-bromo-5-nitro-1,3-dioxane, phenethyl alcohol, o-phenylphenol/sodium o-phenylphenol, sodium hydroxymethylglycinate, polymethoxy bicyclic oxazolidine, dimethoxane, thimersal dichlorobenzyl alcohol, captan, chlorphenenesin, dichlorophene, chlorbutanol, glyceryl laurate, halogenated diphenyl ethers, phenolic compounds, mono- and poly-alkyl and aromatic halophenols, resorcinol and its derivatives, bisphenolic compounds, benzoic esters (parabens), halogenated carbanilides, 3-trifluoromethyl-4,4'-dichlorocarbanilide, and 3,3',4-trichlorocarbanilide. More preferably, the non-cationic antimicrobial agent is a mono- and poly-alkyl and aromatic halophenol selected from the group p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol,o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, and 5-chloro-2-hydroxydiphenylmethane.

Quaternary ammonium based sanitizing agents include any cationic surfactant which is known or may be found to provide a broad antibacterial or sanitizing function. Any cationic surfactant which satisfies these requirements may be used and are considered to be within the scope of the present invention, and mixtures of two or more cationic surface active agents, viz., cationic surfactants may also be used. Cationic surfactants are well known, and useful cationic surfactants may be one or more of those described for example in *McCutcheon's Functional Materials*, Vol. 2, 1998; *Kirk-Othmer, Encyclopedia of Chemical Technology*, 4th Ed., Vol. 23, pp. 481-541 (1997), the contents of which are herein incorporated by reference.

Exemplary cationic surfactant compositions useful in the practice of the instant invention are quaternary ammonium compounds and salts thereof, which may be characterized by the general structural formula:

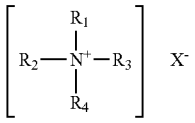

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least about 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex. Such quaternary compounds are available under the BARDAC®, BARQUAT®, HYAMINE®, LONZABAC®, BTC®, and ONYXIDE® trademarks, which are more fully described in, for example, *McCutcheon's Functional Materials* (Vol. 2), North American Edition, 2001, and the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC®& 208M)); described generally in *McCutcheon's* as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, Mx-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT®4280 and BARQUAT® 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (available either as 100% actives or as a 50% actives solution); HYAMINE® 3500 (50% actives), described as alkyl dimethyl benzyl ammonium chloride (also available as 80% active (HYAMINE® 3500-80); and HYAMINE® 2389 described as being based on methyldodecylbenzyl ammonium chloride and/or methyldodecylxylene-bis-trimethylammonium chloride. (BARDAC®, BARQUAT® and HYAMINE®& are presently commercially available from Lonza, Inc., Fairlawn, N.J.). BTC®& 50 NF (or BTC® 65 NF) is described to be alkyl dimethyl benzyl ammonium chloride (50% active); BTC® 99 is described as didecyl dimethyl ammonium chloride (50% active); BTC® 776 is described to be myristalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC®& 818 (50% active) (available also as 80% active (BTC® 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125-80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl-dimethyl benzyl-ammonium saccharinate (95% active). (BTC® and ONYXIDE® are presently commercially available from Stepan Company, Northfield, Ill.).

The chemical compositions of the invention may also comprise a coloring agent which imparts a color to the water in which it comes into contact, and especially which imparts color to the water contained within the sanitary appliance. Where the sanitary appliance is a toilet, desirably the coloring agent imparts a color to the water contained within the cistern, or within the toilet bowl particularly following the flush cycle of a toilet, or may impart a color in both locations. Such coloring agents have great consumer appeal, and indeed any known art coloring agent may be provided in any effective amount in order to impart a coloring effect. Colorants, especially dyes, are preferred when formulated as dry powders to enable direct incorporation into the tablet or block, however, liquid colorants may be employed in conjunction with suitable carriers. When present, colorants are desirably present in an amount from about 0.1 to 15 percent of the total weight of the chemical composition.

While such coloring agents may be used as the sole chemical composition contained within the inventive device, such coloring agents typically combined with cleaning effective amounts of one or more surfactants which provide an effective cleaning benefit.

As noted previously, the chemical compositions of the invention may comprise an anti-limescale agent, which can be classified as a cleaning agent in that it provides a cleaning effect to treated lavatory device surfaces. The anti-limescale agent can virtually any known anti-limescale agent compositions known to those of ordinary skill in the relevant art. For example, compositions containing anionic and/or nonionic surfactants together with typical anti-limescale agents, for example, amidosulfonic acid, bisulfate salts, organic acids, organic phosphoric salts, alkali metal polyphosphates, and the like. Examples of anti-lime scale agent compositions can be found in, for example, U.S. Pat. No. 5,759,974; U.S. Pat. No. 4,460,490; and U.S. Pat. No. 4,578,207, the contents of which are herein incorporated by reference. Further examples of anti-limescale agents include organic acids (for example, citric acid, lactic acid, adipic acid, oxalic acid and the like), organic phosphoric salts, alkali metal polyphosphates, sulfonic, and sulfamic acids and their salts, bisulfate salts, EDTA, phosphonates, and the like.

The chemical compositions may also include other known art additives in effective amounts, such as solubility control agents, water-softening agents, preservatives, flow aids, water-soluble fillers, corrosion inhibitors, and the like.

It will be appreciated by those of ordinary skill in the art that several of the components which are directed to provide a chemical composition can be blended into one chemical composition with the additional appreciation that potential blending of incompatible components will be avoided. For example, those of ordinary skill in the art will appreciate that certain anionic surfactants may have to be avoided as some may be incompatible with certain sanitizing agents and/or certain anti-lime scale agents mentioned herein. Those of ordinary skill in the art will appreciate that the compatibility of the anionic surfactant and the various sanitizing and anti-limescale agents can be easily determined and thus incompatibility can be avoided in the situations.

When the chemical compositions are formed into solid blocks, such blocks can consist entirely of one or more of the chemical compositions which provide an active treatment benefit as described above but such blocks may also contain amounts of one or more active agents together with one or more adjuvants such as lubricants, as well as inactive adjuvants such as fillers known to the art which may be included in art recognized amounts.

Preferably when the chemical composition is in a solid block form, the chemical composition according to the invention is made up into a block of from about 25 to about 75 g, more preferably from about 25 to about 55 g, and more preferably from about 30 to about 45 g. Of course it is to be understood that less than the total amount of the solid block formed may be the chemical composition, with the remaining balance being one or more adjuvants.

The solid block can be made by conventional means. One method of making the block is to melt one or more of the components and then pouring the molten mass into the first chamber of the housing and allowing the mass to cool to room temperature (about 25° C.). Another method is to place the components used to make the block into an appropriate extrusion device and extrude an appropriately sized mass that will fit into the first and/or second chamber of the housing. If the solid block is to be made by extrusion, then processing aids are often included as needed and are included as an adjuvant. The solid block may be formed of a single chemical composition, or may formed of two different chemical compositions which may be provided as separate regions of a solid block, such as a first layer of a solid block consisting of a first chemical composition, alongside a second layer of a the solid block consisting of a second chemical composition which is different than the first chemical compositions. Further layers of still further different chemical compositions may also be present. Such solid blocks formed having two or more discrete layers or regions of, respectively, two or more different chemical compositions may be referred to as composite blocks. Such composite block may be formed by any conventional technique, including, e.g. forming the two (or more) layers or regions of the composite block separately and thereafter assembling the final composite block, as well as coextrusion techniques as known to the art.

When formed as a solid block, such solid blocks may be monolithic or alternately may be in particulate form such as in the form of powders, prills, beads and the like which particulate forms may be conveniently used. The blocks may be formed of a single chemical composition, or may be formed of two or more chemical compositions such as in the form of a multilayered block such as may be formed by coextrusion of the two or more chemical compositions to form a monolithic block. The block may also be formed of two or more separate blocks which are simply layered or otherwise assembled, without or without the use of an adhesive. Any form of the blocks may also be provided with a coating film or coating layer, such as a water soluble film which is used to overwrap the chemical composition provided in the device which film provides a vapor barrier when dry, but which dissolves when contacted with water. Alternately the chemical compositions may be in the form of a gel, which gel may optionally include one or more further solids, e.g., one or more further chemical compositions useful to treat a lavatory appliance within or mixed with the gel.

As noted, the device according to provides a fragrancing effect to the ambient environment of the sanitary appliance, which effect is provided by the presence of a fragrance composition. The fragrance composition may be any composition which is known to the art to provide a perceptible fragrancing benefit, any may be based on naturally occurring materials such as one or more essential oils, or may be based on synthetically produced compounds as well. Examples of essential oils include pine oil, Anetlhole 20/21 natural, Aniseed oil china star, Aniseed oil globe brand, Balsam (Perui), Basil oil (India), Black pepper oil, Black pepper oleoresin 40/20, Bois de Rose (Brazil) FOB, Bomneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Counmarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Guijun balsam Heliotropin, Isobornyl-acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen oil.

Many of these essential oils may also function as a fragrance agent, which fragrance agent which may be a substance or mixture of such substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally fragrance agents are complex mixtures or blends various organic compounds including, but not limited to, certain alcohols, aldehydes, ethers, alamatic compounds and varying amounts of essential oils such as from about 0 to about 85% by weight, usually from about 10 to about 70% by weight, the essential oils themselves being volatile odiferous compounds and also functioning to aid in the dissolution of the other components of the fragrance agent. In the present invention, the precise composition of the fragrance agent desirably emanates a pleasing fragrance, but the nature of the fragrance agent is not critical to the success of the invention. Indeed, is fully contemplated as being within the scope of the invention to include any other material which is useful in providing treatment of ambient air, such as a sanitizing agents such as one or more glycols or alcohols, or materials which are intended to counteract, neutralize, or mask odors in place of, or in conjunction with the fragrance composition of the present invention. Alternatively, it is also contemplated that all or part of the fragrance composition of the present invention is may be substituted by one or more materials which provide and effective insecticide repelling or insecticidal benefit; such would be particularly useful in climates or environments where insects present a nuisance or health hazard.

According to particularly preferred embodiments the fragrance composition is associated solely with the fragrance cavity of the inventive devices. According to one preferred mode of utilizing the inventive device, the device is positioned with respect to a sanitary appliance, particularly a toilet bowl, such that the fragrance cavity does not come into contact with water during the useful life of the device. This provides several simultaneous benefits including, the longevity of the fragrance composition, the improved delivery characteristic of the fragrance composition which does not become submerged or diluted with water associated with the sanitary appliance, as well as the fact that a much broader range of fragrance compositions (or other air treatment compositions as noted above) can be utilized as there is no concern regarding the compatibility of fragrance with the materials in the chemical composition contained within a body cavity of the device. Furthermore, the utilization of the fragrance composition in such manner provides a constant release of the fragrance composition to the ambient environment of the sanitary appliance even when the sanitary appliance is not being the used. In the case where a pleasant fragrance and/or an odor masking composition is provided in the fragrance composition, a beneficial consumer perception of the use of the devices can be realized. Alternately, where a sanitizing agent and/or an insecticidal agent is utilized as all or part of the fragrance composition of the device, the continual benefits of continuous release of such agents may be provided to the ambient environment of the sanitary appliance.

Notwithstanding the foregoing, it is to be understood that a chemical composition used in the device may also comprise a fragrance composition or other air treatment composition as described above. Such however exemplifies a less preferred inventive embodiment for the reasons noted herein.

The form of the fragrance composition, when present, can take any form including, liquid, solid, or gel form. Preferably however, the fragrance composition is a gel system which is then deposited in the fragrance chamber of the device. The gel system can be formed by a variety of components known to those of ordinary skill in the art. For example, it can be formed from absorbents, starch based systems, modified celluloses, natural gums and other materials which can form a gel when the fragrance composition, aforementioned gel components, and water or hydrophilic solvents are mixed together. According to certain particularly advantageous embodiments of the invention the fragrance composition is a gel system as it is described in U.S. Pat. No. 5,780,527, the contents of which are hereby incorporated by reference.

Examples of chemical compositions which can be used with the present invention are shown in the following table below

| Component | Ex. 1 | Ex. 2 | Ex. 3 | Ex. 4 | Ex. 5 |
|---|---|---|---|---|---|
| Dodecyl Benzene Sulfonate Na[1] | 25 | 10 | 40 | 35 | 35 |
| Alfa Olefine Sulfonate Na[2] | 25 | 10 | 5 | 32 | 32 |
| Lauryl monoethanolamide[3] | 10 | 8 | 5 | 2 | 5 |
| Sodium Lauryl Ether Sulfate[4] | 10 | — | — | 4.5 | 5 |
| Pluronic 68[5] | 10 | — | — | 3 | — |
| Na_Sulfate_ | 20 | — | — | 21.5 | 21 |
| Pluronic 87 or 88[6] | — | 70 | 50 | — | — |
| Alcohol ethoxylate $C_9$-$C_{11}$ 6E0[7] | — | 2 | — | — | — |
| Silica | — | — | — | 2 | 2 |

[1]Dodecyl Benzene Sulfonate Sodium (80-90% active) - anionic
[2]Alpha Olefin Sulfonate Sodium -- anionic
[3]Lauryl Monoethanolamide -- non-ionic
[4]Sodium Lauryl Ether Sulfate (70% active) -- anionic
[5]Polyoxyethylene (160) polyoxypropylene (30) glycol - non-ionic
[6]87 $E_{61}$ $P_{41.5}$ $E_{61}$ -- Molecular Weight 7700 -- HLB 24 -- non-ionic
Pluronic 88 $E_{98}$ $P_{41.5}$ $E_{98}$ -- Molecular Weight 10800 -- HLB 28-- non-ionic
[7]Alcohol ethoxylate $C_9$-$C_{11}$ 6E0 -- non-ionic The above exemplary chemical compositions can be made into solid blocks either by melting the various components together and placing the melt into a housing which is used as the first dispenser of the inventive device, or by placing the components into a suitable extruder and extruding out a block having a desired shape and size, and thereafter providing it to the first dispenser of the inventive device.

Exemplary sanitizing compositions for use as chemical compositions in the present invention include compositions having the general compositions described as follows:

A hydantoin tablet containing 94 wt. % Dantochlor powder (about 86% 1,3-dichloro-5,5-dimethylhydantoin) and 6.0 wt. % of an inert binder, comprising a 5 wt. % solution of laponite can be made by extrusion (with a die diameter and shape suited to the proposed first chamber) at a temperature of from about 80 to 90° F. and a pressure at the end of the extruder barrel ranging from about 50 to about 350 psi. An appropriately sized block can then be cut from the extrudate and allowed to cool to room temperature. Another example can use a 2 wt. % solution of laponite. According to other examples the 5 wt. % solution of laponite can be replaced with sodium stearate and water (respectively representing 5 wt. % and 4 wt. % of composition prior to drying; respectively representing 10 wt. % and 6 wt. % of the final composition prior to drying; and respectively representing 6 wt. % and 7.5 wt. % of the composition, prior to drying). Alternately there can be used a binder that contains a 2 wt. % laponite solution and sodium stearate (the laponite solution representing 3 wt. % of the composition and the sodium stearate representing 7.5 wt. % of the composition, prior to drying; a 5 wt. % laponite solution and sodium stearate (respectively representing 3 wt. % and 7.5 wt. % of the composition, prior to drying).

An example of a bleach containing composition suitable for use as a chemical composition in the devices of the present invention include compositions having the following exemplary constituents present in the general ranges as follows:

| Constituent | range (% w/w) |
|---|---|
| Alpha olefin sulfonate | 0-35 |
| Sodium lauryl ether sulfate | 3.0-6.0 |
| Bleaching agent (e.g., DCCNa or Hydantoin) | 0.5-25 |
| Lauryl monoethanolamide | 2.0-5.0 |
| Dodecyl benzene sulfonate Na | 50-70 |
| Na sulfate anhydrous | 15-25 |
| Silica | 1.0-2.0 |

A non-limiting examples of a anti-lime scale agent containing composition useful as a chemical composition in the devices of the present invention include compositions described as follows:

| Description | Qty |
|---|---|
| Spary dried silica | 9.46 |
| Na sulfate | 10.81 |
| Na dodecylbenzenesulfonate (80%) | 74.05 |
| $Na_4$ HEDP | 1.62 |
| Alcohol $C_{13}/C_{15}$ | 1.08 |
| Dye | 2.97 |

Particularly preferred embodiments of cleaning blocks which are useful in the present inventive compositions include those which comprise:

10-35% wt., preferably 15-30% wt. of an alpha olefin sulfonate anionic surfactant;

10-35% wt., preferably 15-30% wt. of a linear monoethanolamide;

5-50% wt., preferably 15-35% wt. of a linear dodecylbenzene sulfonate anionic surfactant;

5-50% wt., preferably 20-35% wt. of sodium sulfate 0.1-15% wt., preferably 0.5-5% wt. of silica 0.1-25% wt., preferably 1-10% wt. sodium lauryl ether sulfate optionally to 40% wt. further additive constituents, including but not limited to further surfactants, fillers, binders, fragrances, processing aids such as lubricants and tabletting aids, bleaches, sanitizing compositions and the like.

The particularly preferred compositions exhibit a long service life when mounted in the devices described herein, which service life is believed to be superior to many known art ITB lavatory cleaning block compositions.

Particularly preferred compositions exhibit a long service life, and additionally exhibit a high ratio of surface area to block volume, preferably wherein the ratio of block volume to block surface area is at least about 0.25, preferably at least about 0.27, more preferably is at least about 0.29, and still more preferably is at least bout 0.30. The long service life of such blocks notwithstanding the large surface area of the blocks exposed to flush water entering the device is surprising.

It is to be understood that the configuration of the dispensing device permits for the use of various combinations of chemical treatment compositions and fragrance compositions. This is due to the fact that dispenser body is are constructed such that the chemical composition contained with the body cavity is physically separated from the fragrance composition which may be present in the fragrance cavity, thus there is no need to ensure the chemical compatibility of chemical composition and fragrance composition present. Such permits for wide variability in the selection and usage of chemical compositions and fragrance compositions in the inventive devices. Certain preferred configurations include a device:

(i) which includes only one chemical composition contained in dispenser body cavity and a fragrance composition is absent;

(ii) which includes only two or more chemical compositions contained in the dispenser body cavity wherein such may be in the form of separate discrete bodies of different chemical compositions, e.g., blocks, strands, rods, powders and the like, or may be laminated or layered bodies comprising two different chemical compositions such as coextruded blocks or bodies, laminated blocks or bodies;

(iii) which is as described in (i) or (ii) but which includes a fragrance composition in the fragrance cavity of the device.

In the devices according to the present invention, it is to be understood that the form of dispenser body is not critical to the successful operation of the invention except that dispenser body have a maximum overall length dimension "L" and a maximum width dimension "W" measured in a plane perpendicularly intersecting "L" wherein the value of "L" to the value of "W" is at least 2×W. Preferably however this relationship between "L" and "W" is wherein L is at least 2.5×W, yet more preferably L is at least 3×W, still more preferably L is at least 3.5×W, especially preferably L is at least is at least 4×W, yet more preferably L is at least 4.5×W, still more preferably L is at least 5×W, and most preferably is at least 7×W, still more preferably at least 9×W. However, the maximum overall length dimension "L" does not exceed 20×W.

The present inventors have surprisingly found that the device having such ratios, as well as preferred ratios provide for excellent delivery of the chemical treatment composition to the sanitary appliance particularly to the bowl of a toilet. During the flush cycle of a toilet, the water which is provided from beneath the rim of the bowl passes through the dispenser body containing one or more chemical compositions and thereby forms the treatment composition which is provided to the sanitary appliance, viz., toilet bowl.

According to particularly preferred embodiments of the-invention the dispenser body is sufficiently flexible in order to permit for adaptive placement of the device in a sanitary appliance, particularly a toilet bowl. According to certain preferred. embodiments the dispenser body include a fragrance cavity having at least one surface open to the ambient environment, or in gaseous communication with the ambient environment. Such a preferred embodiment permit for the ready discharge of the fragrance composition to the ambient environment of the sanitary appliance and the provision of a desirable fragrance or air treatment effect. In certain embodiments the fragrance cavity may have an exposed face or surface which is open to the ambient environment, while in other preferred embodiments an intermediate member, e.g., a screen, wick plate or permeable membrane, which permits for the discharge of the fragrance composition to the ambient environment may be provided. In certain preferred embodiments the fragrance cavity is present within the interior of the dispenser body, and an intermediate wall separates the fragrance cavity from the body cavity. Desirably the dispenser body includes at least one or more perforations or passages which permit for the contact of water with the chemical compositions contained within the body cavity, where said water contacts a chemical compositions which may be present in the body cavity, and thereafter exit the device.

A further element of the device according to the invention is a hanger adapted for removably hanging the device upon a portion of a sanitary appliance. Preferably the hanger depends from device at or near its midpoint between the two ends of the device. The form of the hanger may take any shape form or configuration which is found satisfactory. Ideally, the hanger is generally in the form of a rigid, semi-rigid or flexible strip or hook which may be made of a single element, such as a single flexible element, or which may be made from a plurality of separate elements which are linked or joined together such as an assemblage of jointed articulated sections adapted to be hung upon a portion of a sanitary appliance. In use, according to preferred methods for utilizing the dispenser, the hanger is used to suspend the device within the flow path of water within the sanitary appliance, while simultaneously suspending the device such that the fragrance composition does not normally into contact with water, nor within the flow path of water within the sanitary device. According to a particularly preferred method of use, the device is utilized in conjunction with a toilet bowl such that, the hanger suspends the device beneath the rim of a toilet bowl so that the dispenser body is at least partially suspended within the flow path of flowing water, e.g., flush water, within the sanitary appliance such that, during the release of flush water, at least part of flush water enters the body cavity. Other methods of use, although not specifically recited here are also contemplated as being within the scope of the present invention.

Preferably the dispenser body is flexible so that it may approximately conform to the configuration of the sanitary appliance. More preferably the dispenser body is deformable so that it may be bent or shaped to approximately conform to the configuration of the sanitary appliance particularly in beneath the rim of a toilet bowl. Such flexure allows for a close placement within the flow path of water within the sanitary device and due to the rather large ratio of the maximum overall length dimension "L" and a maximum width dimension "W" measured in a plane perpendicularly intersecting "L" the area to which the treatment composition is supplied is greater than with known art prior devices. The inventors have surprisingly found that notwithstanding the larger ratio of "L" to "W", chemical compositions may be formulated and used in the devices with excellent cleaning and/or sanitization results while at the same time providing a useful service life to device. The large exposed surface area of the chemical compositions, particularly in the form of blocks, provide for good surface contact with flush water and excellent dispensing of the treatment composition to the toilet bowl. This is particularly enhanced where the flush water swirls within the interior of the toilet bowl which thus dispenses the treatment composition more effectively to the surfaces contacted with flush water. Desirably the dispenser body is sufficiently flexible, preferably is sufficiently permanently deformable such that the angle of deflection of the midpoint of at least one end of the dispenser body, as measured between an original, linear configuration and its deformed configuration as measured from the midpoint between the two ends of the dispenser body is at least 5°, preferably is at least about 8°, and most preferably is at least about 10° or more.

The various elements of the device according to the invention can be formed out of any of a variety of materials with synthetic polymers being preferred. Exemplary suitable synthetic polymers include polyethylene, polypropylene, and the like; the only criteria being that the selected synthetic polymers is not affected by the components of the treatment composition, or fragrance composition particularly when in a gel form or solid form.

In one preferred form of the invention, the device includes a dispenser body which is both rigid and arcuate, which does not require that it be deformed in order to approximately conform to the configuration of the sanitary appliance particularly in beneath the rim of a toilet bowl.

The device according to the invention may also have a different geometry, configuration nor and appearance than the embodiments described in the Figures.

Certain particularly preferred embodiments of the inventive device are described in the following figures. In the accompanying figures, like elements are indicated using the same numerals throughout the figures.

FIG. 1 illustrates a perspective frontal view of a first preferred embodiment of a dispenser body 20 of a dispensing device 10 according to the first aspect of the invention which includes dispenser body 20. In this embodiment the dispenser body 20 is formed from two parts, a front body part 21 and a back body part 22 which are connected by an intermediate hinge about which the front body part 21 and back body part 22 may be moved and fitted together to form the dispenser body 20. Each of the front body part 21 and the back body part 22 comprises a wall, a front body wall 24 and a back body wall 25 which is generally arcuate in cross-sectional shape. Each of the front body wall 24 and a back body wall 25 define a body cavity 27 when the front body part 21 and a back body part 22 are fitted together. The body cavity 27 may be used to contain the chemical composition, and optionally the fragrance composition of the device. As is visible from the figure, each of the front body wall 24 and a back body wall 25 comprise at least one, here a plurality of passages 28 which breach the respective front body wall 24 and a back body wall 25 and provide means for the entry of water into the dispenser body 20, as well for the egress of treatment composition from within the dispenser body 20. Adjacent to each end 29, 30 of the dispensing device and within the interior of the body cavity 27 is provided a fragrance cavity 31, 32. In the depicted embodiment there are provided two fragrance cavities 31, 32 each within the interior of the dispenser body and formed by the space between the end 29, 30 and a barrier wall 33, 34 which spans a portion of the back body wall 25 to define a cavity or chamber therebetween. The barrier wall 33, 34 provides for a physical barrier which divides and isolates the chemical composition which, although not shown, is understood to be present in the body cavity 27 of the dispenser body, and the fragrance composition which although not shown is to be understood to be within the interior of at least one of the fragrance cavities 31, 32. Further visible are vent passages 35, 36 which pass through the front body wall 24 proximate to the ends 29, 30 of the front body part 21, and are positioned to permit for the passage of an air treatment composition such as a fragrance to exit the fragrance cavities 31, 32 therethrough and into the ambient environment of the sanitary appliance, e.g. toilet bowl. As is also visible from FIG. 1, the interior of each of the fragrance cavities 31, 32 includes a plurality of anchor elements 37, 38 which depend from the back body wall 25. While such a feature is optional, the presence of anchor elements 37, 38 provide for improved retention of a fragrance composition when such is in the form of a gel or paste. Of course it is to be understood that the anchor elements 37, 38 may be of different configuration than the short post-like forms depicted.

Each of the front body part 21 and a back body part 22 including corresponding mating means which may be used to provide a releasable or non-releasable closure of the front body part 21 and a back body part 22 in order to form the dispenser body 20. In the depiction there are provided a series of female connecting elements 39 on the back body part 22 which join with corresponding male connecting elements 40 provided on the front body part 21. While mechanical elements are herein depicted, it is to be understood that mating means may include any element or device which may be used to close the front body part 21 and a back body part 22 including but not limited to: mechanical fasteners or elements, friction fitted portions of the front body part 21 and a back body part 22, chemical materials such as adhesives, as well as welds or bonds.

The device 10 also includes a connector 41 which, in the depicted embodiment is positioned on or as part of the front body part 21. The connector is provided as a seat for an end of the hanger, which is also not depicted in FIG. 1. Any configuration for the connector 41 is envisioned and indeed two or more connectors may be present to accommodate an appropriate hanger or plurality of hangers.

While not shown, it is to be understood that the fragrance cavities may be adapted to received suitably shaped receptacles which separately contain the fragrance compositions. Such suitably shaped receptacles may be in the form of shaped cups which are prefilled with a suitable quantity and type of fragrance compositions which may be conveniently inserted into the fragrance cavities of the inventive device.

Figure 2:
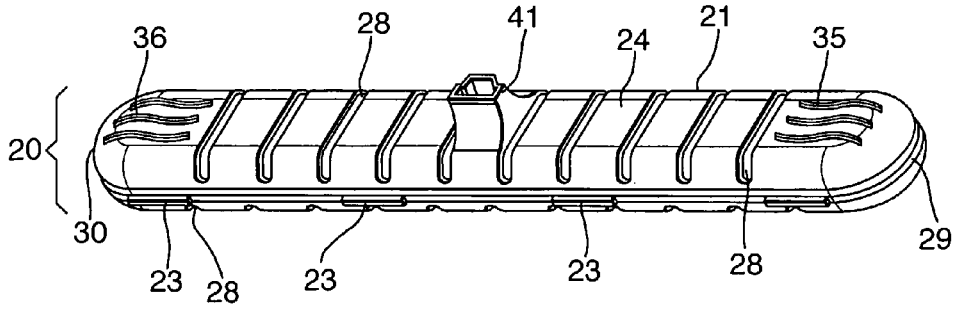
FIG. 2 illustrates an alternate view of the dispenser body of FIG. 1.

FIG. 2 depicts an alternate view of the dispenser body 20 of FIG. 1 in a closed configuration. Now more clearly visible are the vent passages 35, 36 which pass through the front body wall 24 proximate to the ends 29, 30 of the front body part 21, positioned to permit for the passage of an air treatment composition therethrough and into the ambient environment of the sanitary appliance.

Figure 3:
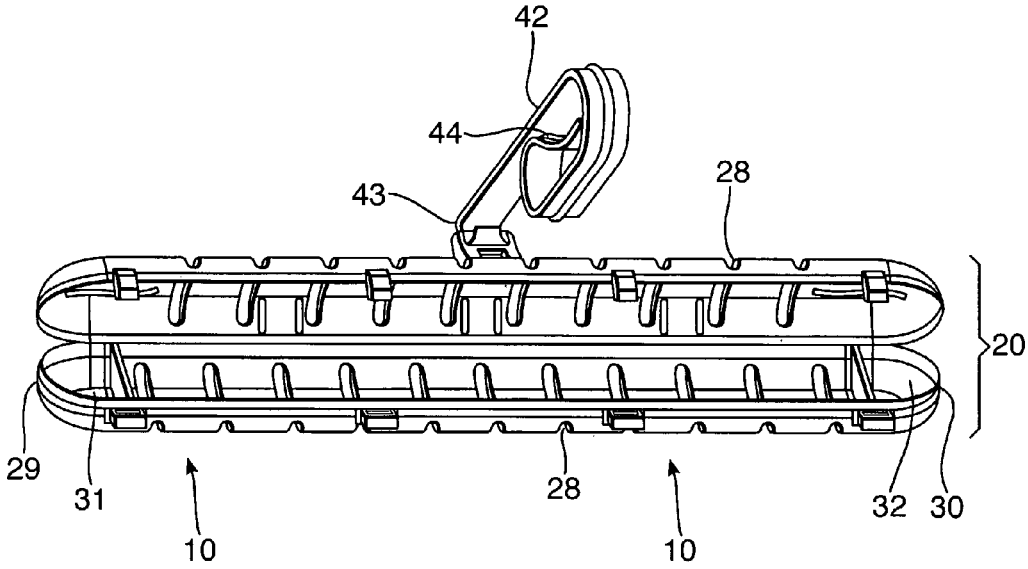
FIG. 3 illustrates further embodiment of a dispensing device.

FIG. 3 illustrates a further view of the embodiment of the dispensing device 10 generally in accordance with FIGS. 1 and 2, which depiction includes a dispenser body 20 and a hanger 42 in the configuration of a foldable, flexible hook having a proximal end 43 which attaches to the connector 41, and a distal end 44 at the other end. The embodiment of the hanger 42 depicted is particularly preferred and advantageous in that when formed of flexible material, in a closed configuration as illustrated it is relatively compact but easily unfolds and extends at its distal end 44 to form a hanger which is well adapted to be suspended upon the rim of a sanitary appliance. FIG. 3 also differs from the embodiment according to FIGS. 1 and 2 as no anchor elements are present.

Figure 4:
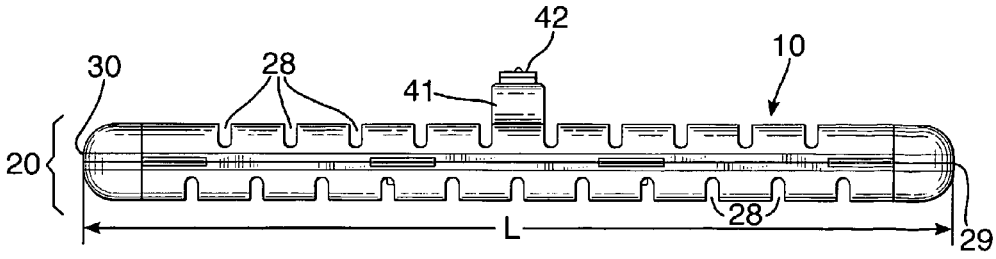
FIG. 4 illustrates a plan view of the device of FIG. 4.

FIG. 4 depicts a bottom, plan view of the dispensing device 10 depicted on FIG. 3. FIG. 4 also depicts that the dispenser body 20 has a maximum overall length dimension "L" as measured between the ends 29, 30 of the dispenser body 20.

Figure 5:
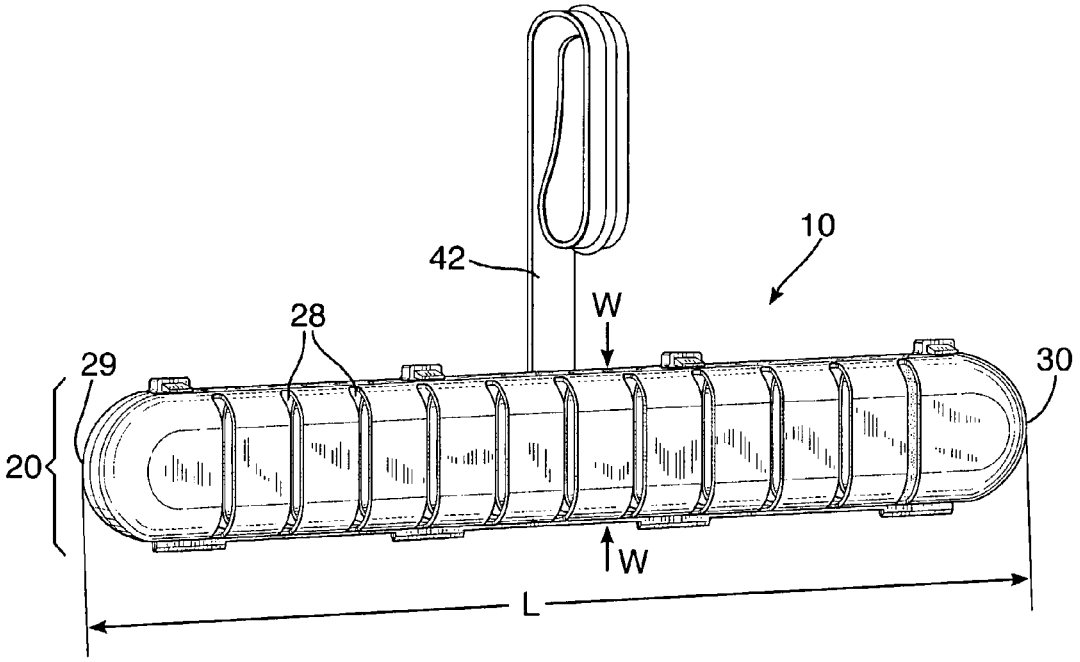
FIG. 5 depicts a further view of the device of FIGS. 3 and 4.

FIG. 5 depicts the dispensing device 10 of FIGS. 3 and 4. The figure also depicts that the dispenser body 20 has a maximum overall length dimension "L" as measured between ends 29, 30 and a maximum width dimension "W" measured in a plane perpendicularly intersecting "L" at the maximum width of the dispenser body 20. As may be determined from FIG. 5, the value of "L" is at least 6.5 times that of "W" in accordance with preferred embodiments of the invention.

Figure 6:
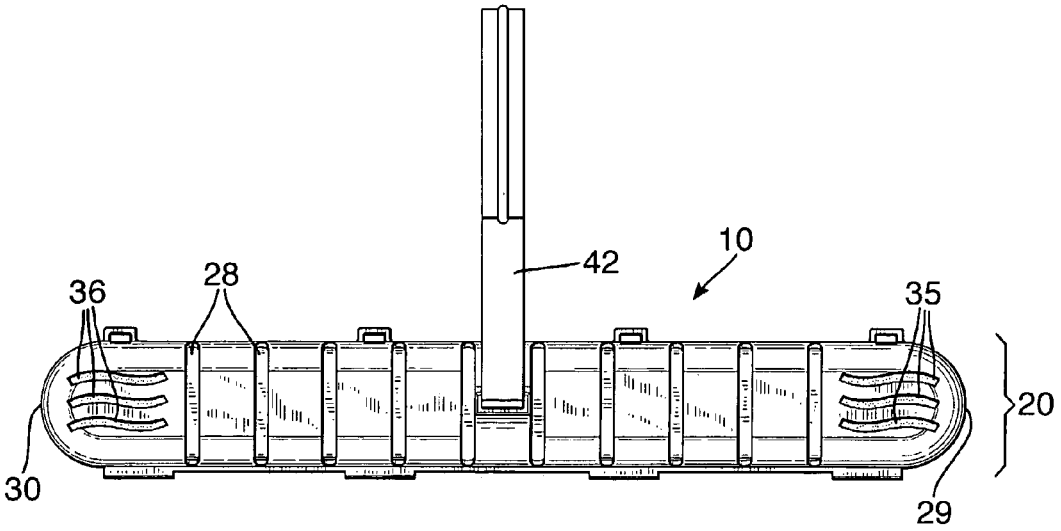
FIG. 6 illustrates a plan view of the device according to FIGS. 3-5.

FIG. 6 illustrates a plan view of the front of the dispensing device 10 according to FIGS. 3, 4 and 5. The overlaid arrangement of the vent passages 35, 36 and corresponding fragrance cavities 31, 32 are more visible this Figure.

Figure 7:
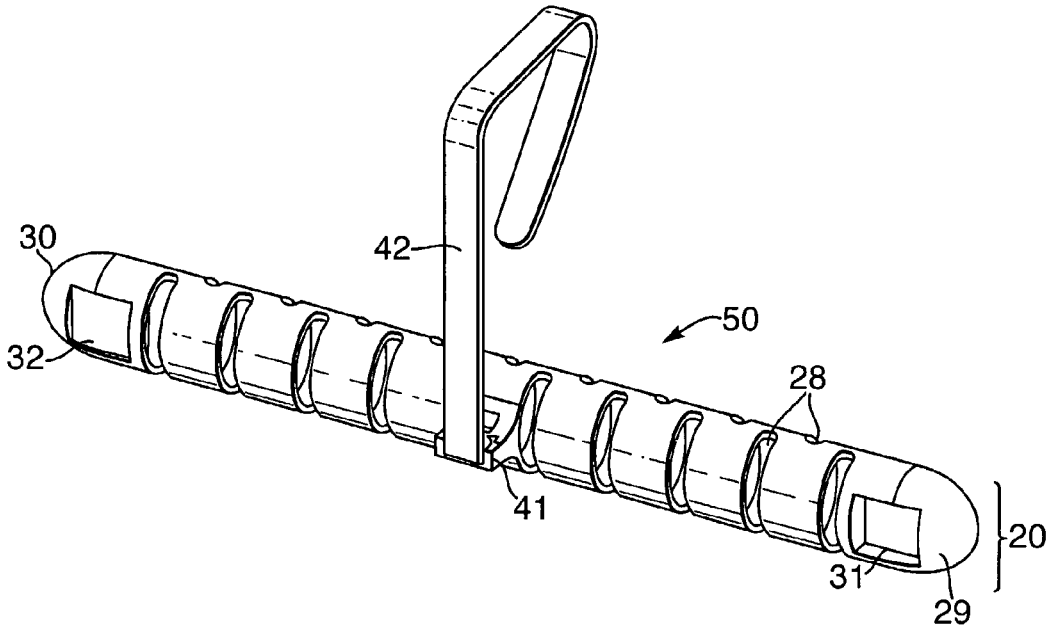
FIG. 7 depicts an alternate embodiment of a dispensing device.

FIG. 7 depicts a further embodiment of a dispensing device 50 according to the invention. The device 50 includes a hanger 42 which is affixed to a dispenser body 20 which is generally tubular in cross-sectional configuration and which further includes exterior fragrance cavities 31, 32 proximate to each end 29, 30 of the dispenser body 20. As is visible from the figure, the exterior fragrance cavities 31, 32 are directly exposed to the ambient environment. When mounted in the rim of a sanitary appliance by means o the hanger 42, the exterior fragrance cavities 31, 32 are positioned to face away from the flow of flushing water.

Figure 8:
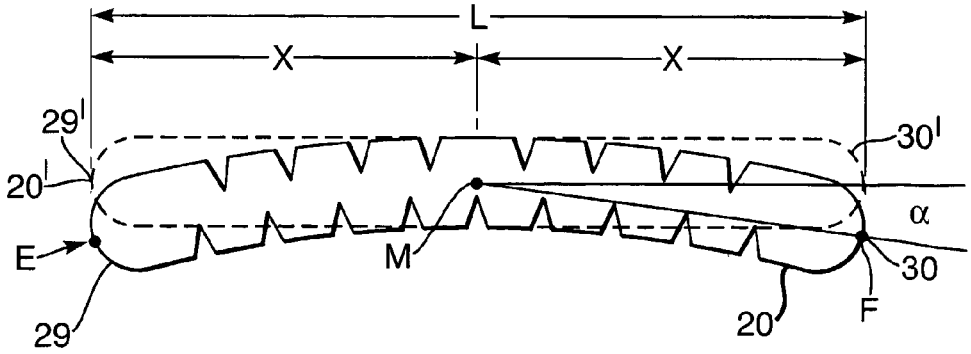
FIG. 8 depicts a dispensing device.

FIG. 8 illustrates a representation of the preferred flexible nature of preferred embodiments of the dispenser body 20 of the invention. FIG. 8 illustrates a dispenser body 20' in an initial linear configuration depicted in phantom, and the same dispenser body 20 in a deformed configuration. The dispenser body 20 has two opposite ends 29, 30 each having respective endpoints E, F which a collinear with the midpoint M of the dispenser body which is on the midpoint of a plane passing through the dispenser body 20 perpendicular to the endpoints E, F at a distance "x" midway the maximum overall length dimension "L" of the dispenser body 20. The angle of deflection "$\alpha$" of the midpoint of at least one end of the dispenser body, as measured between an original, linear configuration and its deformed configuration as measured from the midpoint between the two ends of the dispenser body is at least 5°.

Figure 9A:
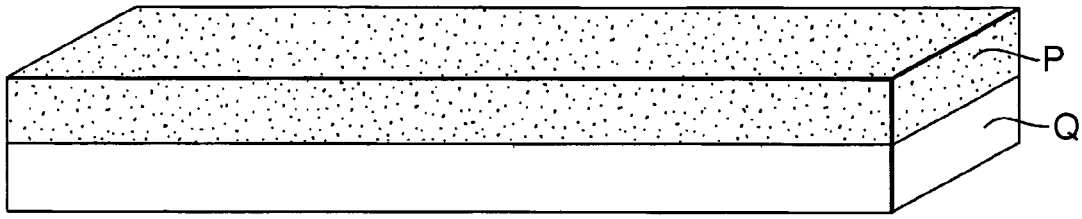
FIGS. 9A, 9B and 9C illustrate examples of chemical compositions in the form of blocks.
Figure 9B:
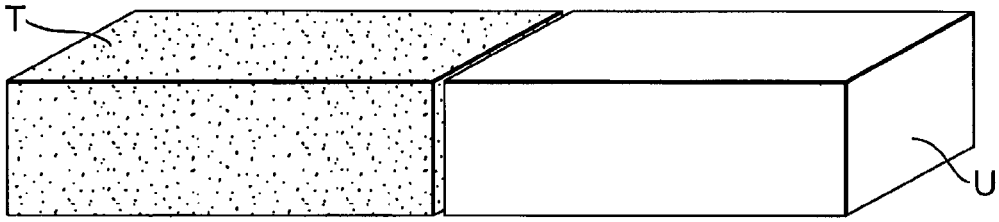
Figure 9C:
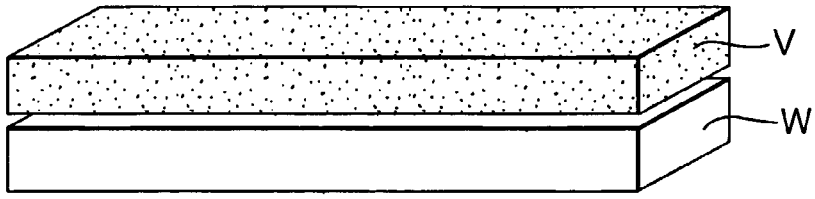

FIGS. 9A, 9B, and 9C depict several examples of chemical compositions in the form of block which may be used with the dispensing device of the present invention. FIG. 9A depicts a multilayered block such as may be formed by coextrusion of two or more chemical compositions to form a monolithic block. When so coextruded the block forms a laminated construction with the first layer P bound to the second layer Q, which is easily handled, and which provides the simultaneous benefit of both the first and second chemical compositions to the sanitary appliance containing such a coextruded block. FIG. 9B depicts two separate blocks formed of different chemical compositions, a first block T and a second block U which are placed end to end abutting one another within the sanitary appliance containing the same. FIG. 9C depicts two further separate blocks, a first block V and a second block W which are formed from different chemical compositions which are not laminated or coextruded but rather as simply placed abutting one another. While not illustrated, it is of course contemplated that a single chemical composition may be formed into a single monolithic block. Each of the foregoing blocks may be of different geometries and configurations it being only required that they be dimensioned so that they may be fitted within the dispenser body 20.

Figure 10:
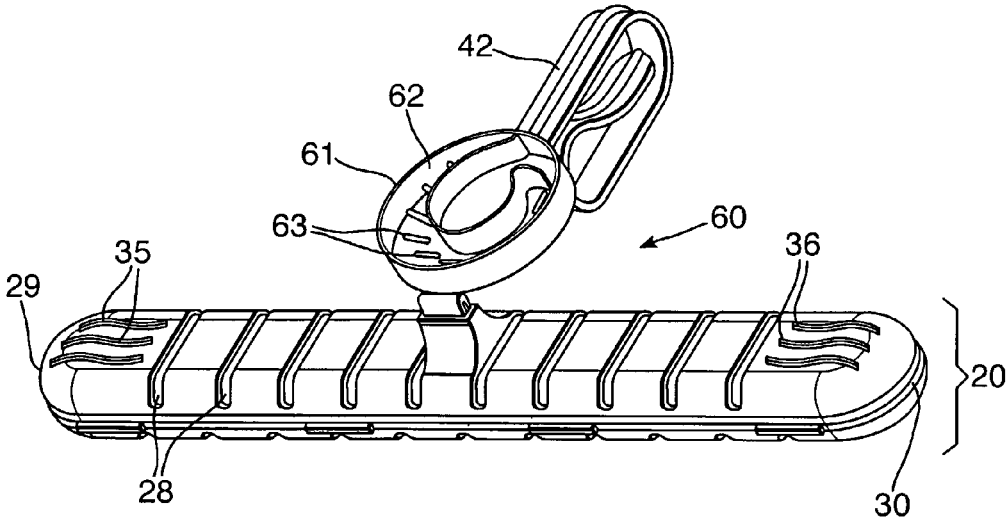
FIG. 10 illustrates a further embodiment of a dispensing device.

FIG. 10 illustrates a further embodiment of a dispensing device 60 according to the present invention which comprises a dispenser body 20, and a hanger 42 which has depending therefrom or integrated therewith a secondary fragrance carrier 61 adapted to contain a quantity of a fragrance composition. The dispenser body 20 is substantially as shown in prior FIGS. 1 and 2. The secondary fragrance carrier 61 comprises a fragrance cavity 62 which is adapted to contain a quantity of a fragrance composition, in a manner substantially the same as described previously with reference to prior figures and embodiments. The depicted secondary fragrance carrier 61 comprises a fragrance cavity 62 dimensioned for containing a quantity of a fragrance composition and further, includes a plurality of anchor elements 63 provided to improve the retention of a fragrance composition particularly when such is in the form of a gel or paste. Of course it is to be understood that the anchor elements 63 may be of different configuration than the short spike shaped forms depicted.

Figure 11:
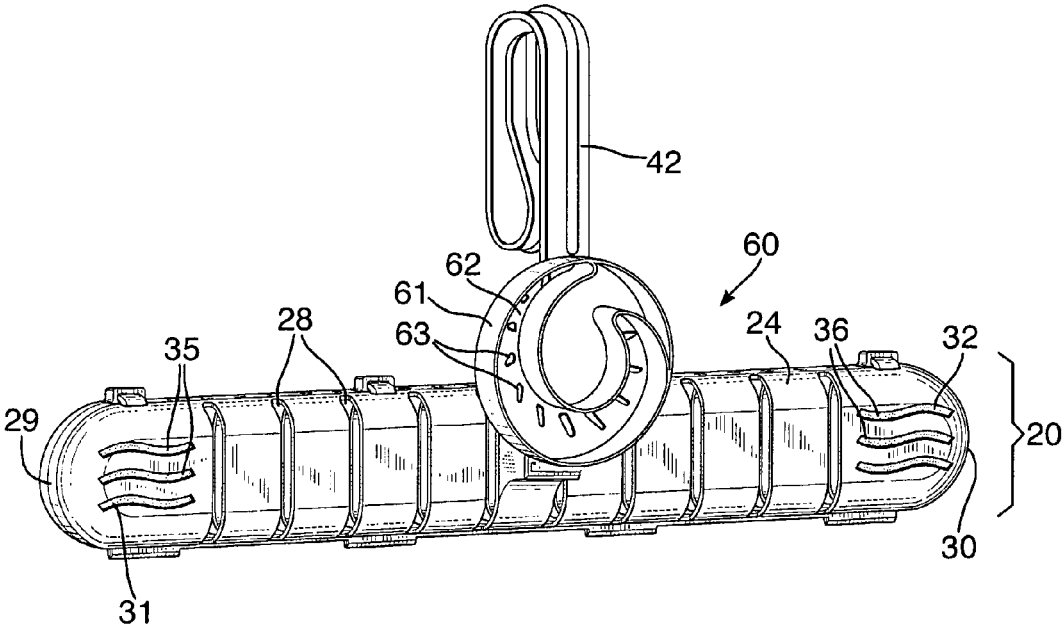
FIG. 11 depicts a frontal perspective view of the device of FIG. 10.

FIG. 11 illustrates a further frontal perspective view of the dispensing device 60 of FIG. 10. As is more clearly visible from the present figure, the vent passages 35, 36 pass through the front body wall 24 and are positioned to permit for the passage of an air treatment composition such as a fragrance to exit the fragrance cavities 31, 32 within the interior of the dispenser body 20 therethrough, and into the ambient environment of the sanitary appliance, e.g. toilet bowl.

Figure 12:
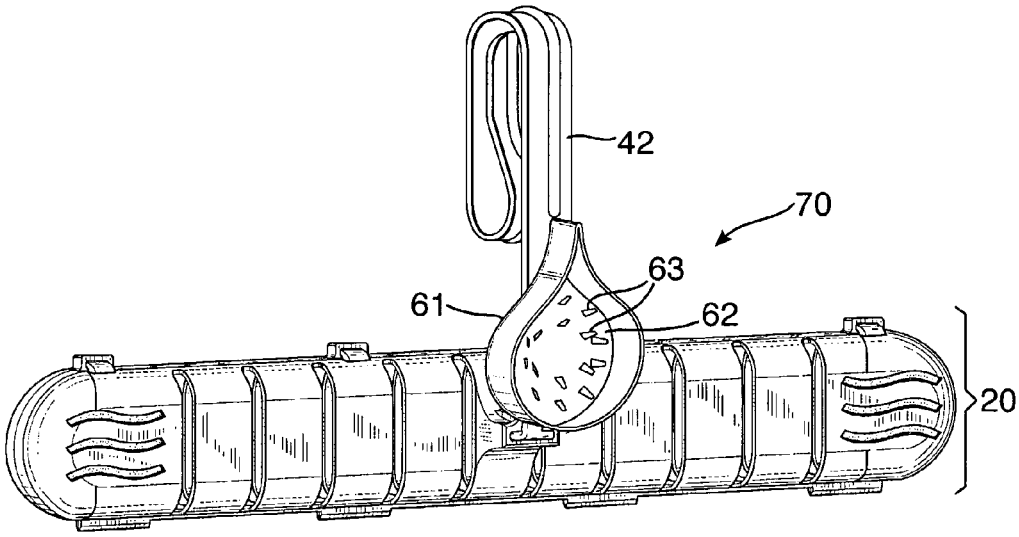
FIG. 12 depicts a further embodiment of a dispensing device.

FIG. 12 depicts a yet further embodiment of a dispensing device 70 according to the present invention which comprises a dispenser body 20, and a hanger 42 which has depending therefrom or integrated therewith a secondary fragrance carrier 61 adapted to contain a quantity of a fragrance composition. Similar to the depicted embodiment of FIG. 11, the presently depicted secondary fragrance carrier 61 comprises a fragrance cavity 62 dimensioned for containing a quantity of a fragrance composition and further, includes a plurality of anchor elements 63 provided to improve the retention of a fragrance composition particularly when such is in the form of a gel or paste. The overall configuration of the secondary fragrance carrier 61 differs from that depicted on prior FIG. 11 but otherwise operates in a similar manner.

Figure 13:
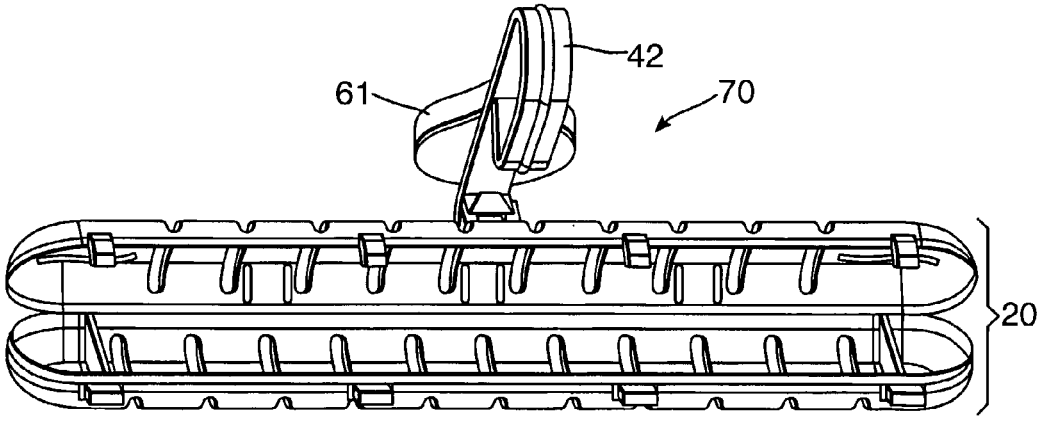
FIG. 13 illustrates a further view of the device of FIG. 12.

FIG. 13 depicts an alternate perspective view of the dispensing device 70 of FIG. 12, illustrating the dispenser body 20 in an open configuration, and allowing for a view of the interior; the dispenser body 20 has a configuration which is essentially the same as the dispenser body of FIG. 3.

Figure 14:
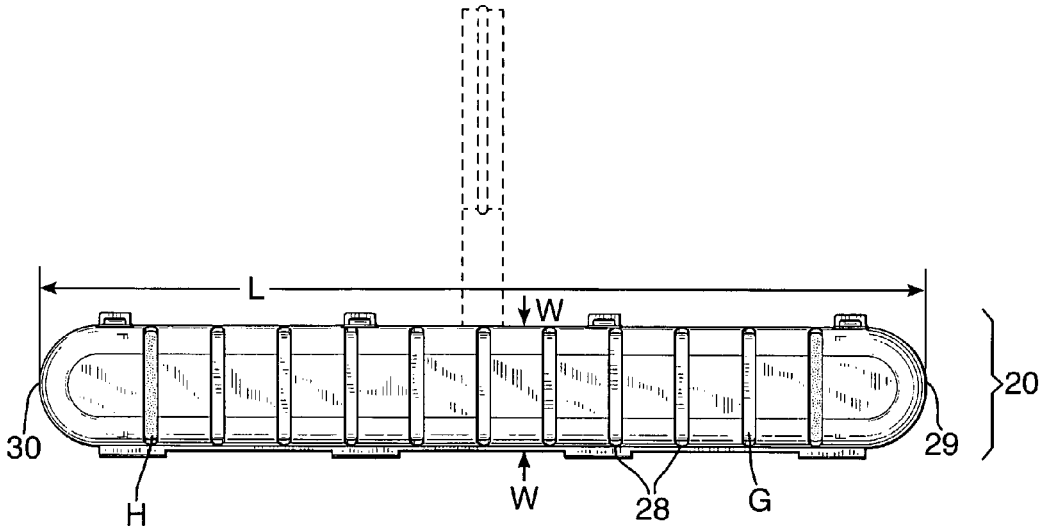
FIG. 14 depicts a further embodiment of a dispenser body.

FIG. 14 depicts a rear plan view of a dispensing body 20 as substantially as described with reference to FIGS. 1-6, with the hanger shown in phantom. However in the present figure a chemical composition in the form of a block G is positioned within the interior of the dispensing body 20, as is visible through the plurality of passages 28 present. The figure also depicts that the dispenser body 20 has a maximum overall length dimension "L" as measured between ends 29, 30 and a maximum width dimension "W" measured in a plane perpendicularly intersecting "L" at the maximum width of the dispenser body 20. As may be determined from the Figure, the value of "L" is at least 6.5 times that of "W" which is in accordance with preferred embodiments of the invention.

Figure 15:
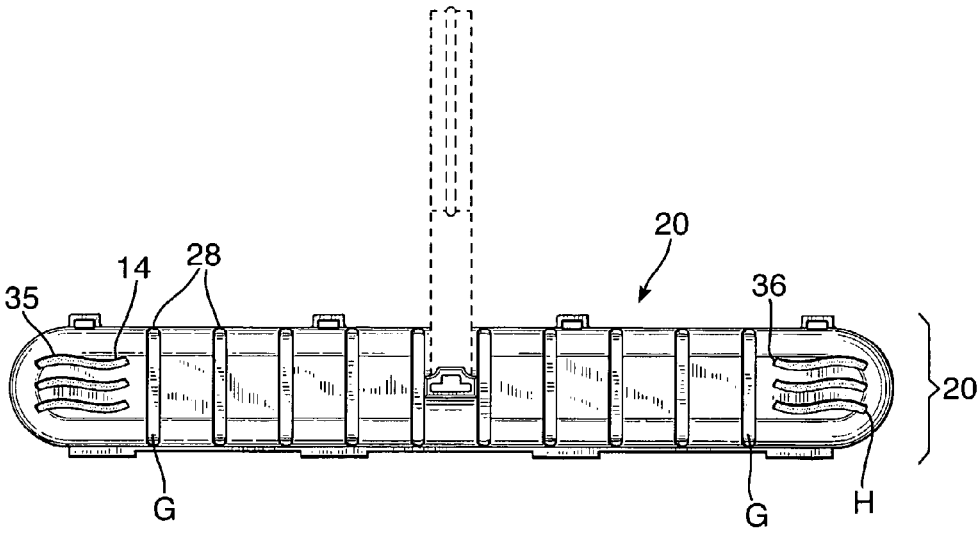
FIG. 15 illustrates a frontal plan view of the dispenser body of FIG. 14.

FIG. 15 illustrates the dispenser body of FIG. 14 but in a frontal plan view. As is visible from the present figure, in addition to the chemical composition G, there are also visible through the vent passages 35, 36 the fragrance composition H.

Figure 16:
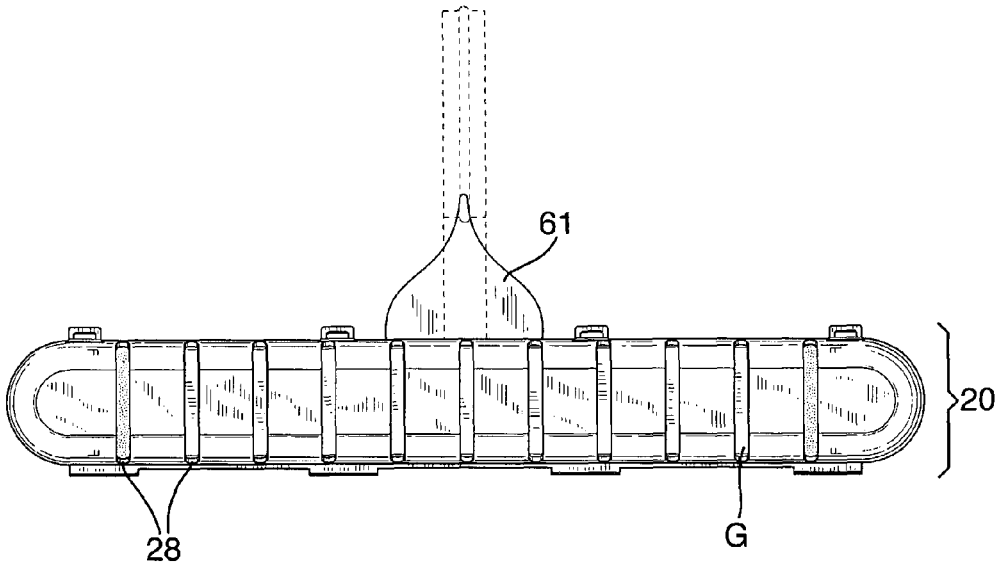
FIG. 16 illustrates a dispensing device which further includes a secondary fragrance carrier.

FIG. 16 depicts a dispensing body substantially as described with reference to FIG. 14, but also depict the rear of a secondary fragrance carrier 61 adapted to contain a quantity of a fragrance composition depending from a hanger, the hanger being shown in phantom.

Figure 17:
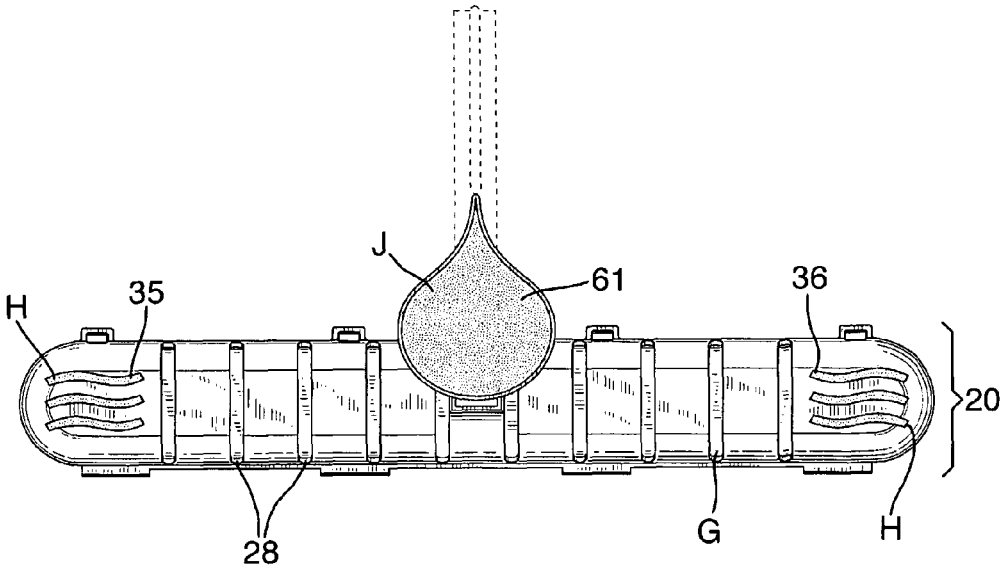
FIG. 17 illustrates a further view of a dispensing device according to FIG. 16.

FIG. 17 illustrates the dispensing body of FIG. 16 but in a frontal plan view. As is visible from the present figure, in addition to the chemical composition G, and the fragrance composition H visible through the vent passages 35, 36 there is also visible the front of the secondary fragrance carrier containing a quantity of a fragrance composition J, which may be the same as fragrance composition H or which may be different.

Figure 18:
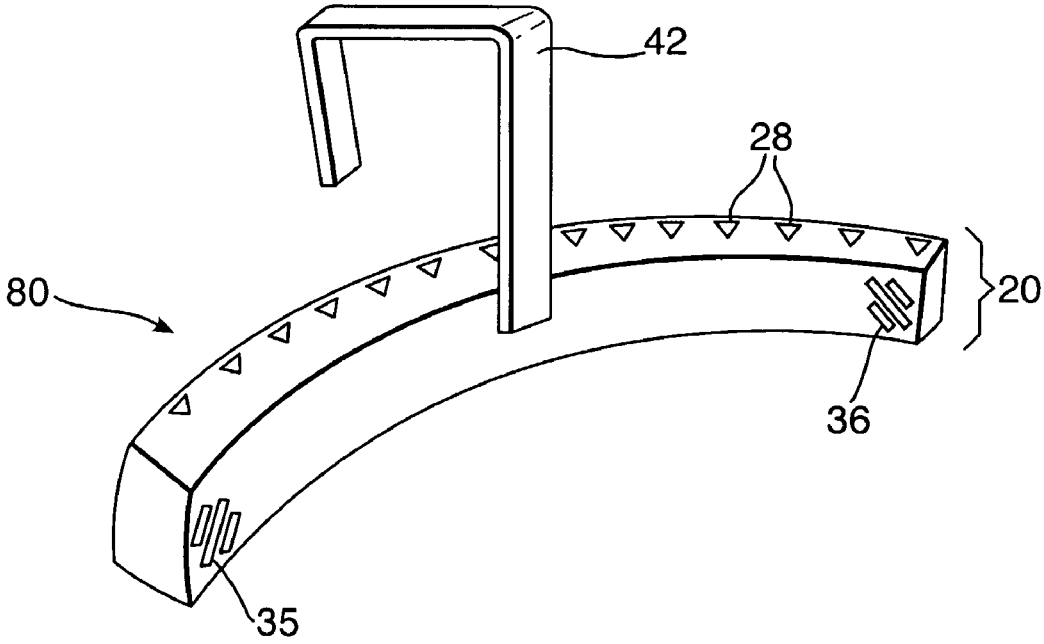
FIG. 18 illustrates a further embodiment of a dispensing device having an arcuate shaped dispenser body.

FIG. 18 illustrates a further embodiment of the invention wherein the dispensing device 80 comprises an arcuate shaped dispenser body 20 having a plurality of passages 28 to permit for the ingress and egress of water, and vent passages 35, 36 to permit for the egress of fragrance composition from within the fragrance cavity (not shown) of the dispensing device 80. Desirably the arc of the arcuate shaped dispenser body 20 approximately conforms to the configuration of the sanitary appliance particularly in beneath the rim of a toilet bowl. The arcuate shaped dispenser body is preferably rigid and does not need to be deformed or bent prior to installation in a sanitary appliance.

Figure 19:
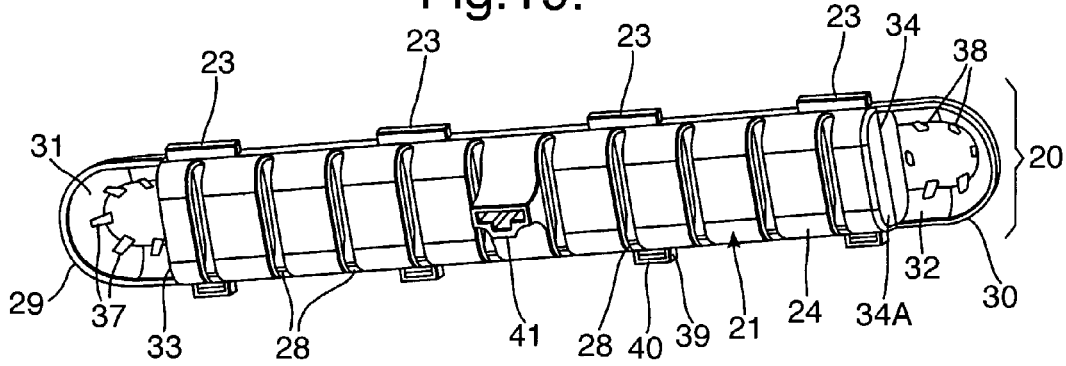
FIG. 19 illustrates a further embodiment of a dispenser body according to the invention.

FIG. 19 illustrates a further embodiment of a dispenser body 20 of the invention which is similar in many respects to the embodiment discussed with reference to FIGS. 1-6. According to the present embodiment, similarly the dispenser body 20 comprises two parts, a front body part 21 and a back body part 22 connected by intermediate hinges 23 about which the front body part 21 and back body part 22 may be moved and fitted together to form the dispenser body 20. Each of the front body part 21 and the back body part 22 comprises a wall, respectively a front body wall 24 and a back body wall 25 which is generally arcuate in cross-sectional shape. Each of the front body wall 24 and a back body wall 25 define a body cavity 27 when the front body part 21 and a back body part 22 are fitted together. The body cavity 27 may be used to contain the chemical composition(s), while a portion of the back body wall 22 may be used to contain the fragrance composition of the device. As is visible from the figure, each of the front body wall 24 and a back body wall 25 comprise at least one, here a plurality of passages 28 which breach the respective front body wall 24 and a back body wall 25 and provide means for the entry of water into the dispenser body 20, as well for the egress of treatment composition from within the dispenser body 20. Adjacent to each end 29, 30 of the dispensing device but exterior to the body cavity 27 is provided a fragrance cavity 31, 32. As depicted, there are provided two fragrance cavities 31, 32 each exterior to the body cavity 27 and formed by the space between the end 29, 30 and a barrier wall 33, 34 which spans a portion of the back body wall 25 to define a cavity or chamber therebetween. The barrier wall 33, 34 provides for a physical barrier which divides and isolates the chemical composition(s) which, although not shown, is understood to be present in the body cavity 27 of the dispenser body 20, and the fragrance composition which although not shown is to be understood to be within the interior of at least one of the fragrance cavities 31, 32. In the present embodiment the front body part further includes endwalls 33A, 34A which are configured such that when the front body part 21 and back body part 22 are closed upon one another, endwall 33A abuts barrier wall 33, and endwall 34A abuts barrier wall 34. Such a configuration physically isolates the fragrance composition from the chemical composition(s) contained in the body cavity 27. As is evident, the interior of the fragrance cavities 31, 32 are exposed to the ambient environment and are not obscured, such as by a baffled cover or vented plate or cover. Such an embodiment provides for unhindered delivery of the fragrance composition to the ambient environment of the device, e.g. toilet bowl. As is also visible from FIG. 1, the interior of each of the fragrance cavities 31, 32 includes a plurality of anchor elements 37, 38 which depend from the back body wall 25. While such a feature is optional, the presence of anchor elements 37, 38 provide for improved retention of a fragrance composition when such is in the form of a gel or paste. Of course it is to be understood that the anchor elements 37, 38 may be of different configuration than the slanted, tapered plate forms depicted.

Each of the front body part 21 and a back body part 22 including corresponding mating means which may be used to provide a releasable or non-releasable closure of the front body part 21 and a back body part 22 in order to form the dispenser body 20. In the depiction there are provided a series of female connecting elements 39 on the back body part 22 which join with corresponding male connecting elements 40 provided on the front body part 21. While mechanical elements are herein depicted, it is to be understood that mating means may include any element or device which may be used to close the front body part 21 and a back body part 22 including but not limited to: mechanical fasteners or elements, friction fitted portions of the front body part 21 and a back body part 22, chemical materials such as adhesives, as well as welds or bonds.

Advantageously the respective peripheries L1, L2 of the portions of the front body part 21 and back body part 22 which are closed upon one another to define the body cavity 27 are each rabbetted, such that a lapped juncture is formed when the dispenser body 20 is assembled. Such a lapped juncture is advantageously and preferably used in the various embodiments of the invention as providing good structural integrity to the closure of the front body part 21 and back body part 22 and in defining the body cavity 27.

The device 10 also includes a connector 41 which, in the depicted embodiment is positioned on or as part of the front body part 21. The connector is provided as a seat for an end of the hanger, which is however not depicted. Any configuration for the connector 41 is envisioned and indeed two or more connectors may be present to accommodate an appropriate hanger or plurality of hangers. The embodiment illustrated on FIG. 19 may be used with any suitable hanger, including any of the embodiments of hangers discussed with reference to the figures.

Although not specifically depicted in FIG. 19, it is to be understood that the fragrance cavities may be adapted to received suitably shaped receptacles which separately contain the fragrance compositions. Such suitably shaped receptacles may be in the form of shaped cups which are prefilled with a suitable quantity and type of fragrance compositions which may be conveniently inserted into the fragrance cavities of the inventive device.

Figure 20:
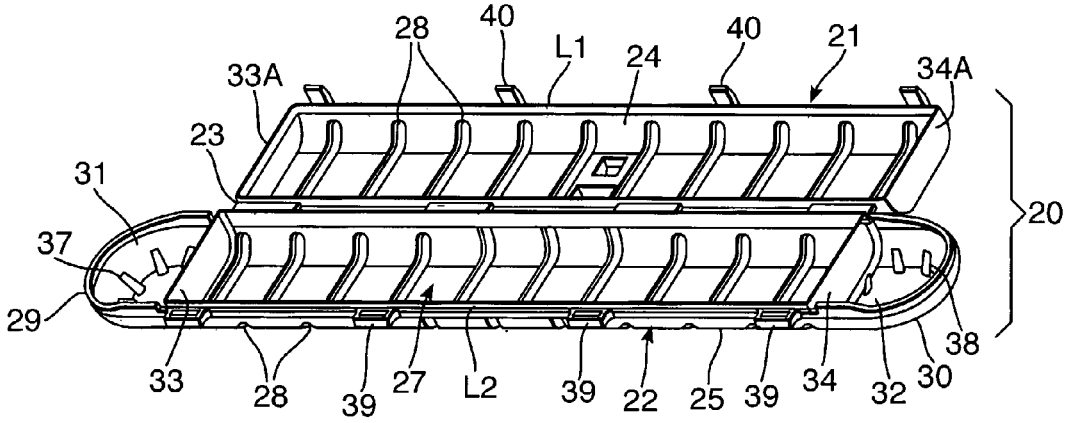
FIG. 20 depicts a further view of the dispenser body illustrated on FIG. 19.

FIG. 20 depicts a further view of the dispenser body 20 illustrated on FIG. 19, in herein an open configuration. More clearly visible are the relationship of certain of the elements discussed with reference to FIG. 19, including the corresponding arrangement of barrier wall 33 with endwall 33A, and barrier wall 34 with endwall 34A.

Figure 21:
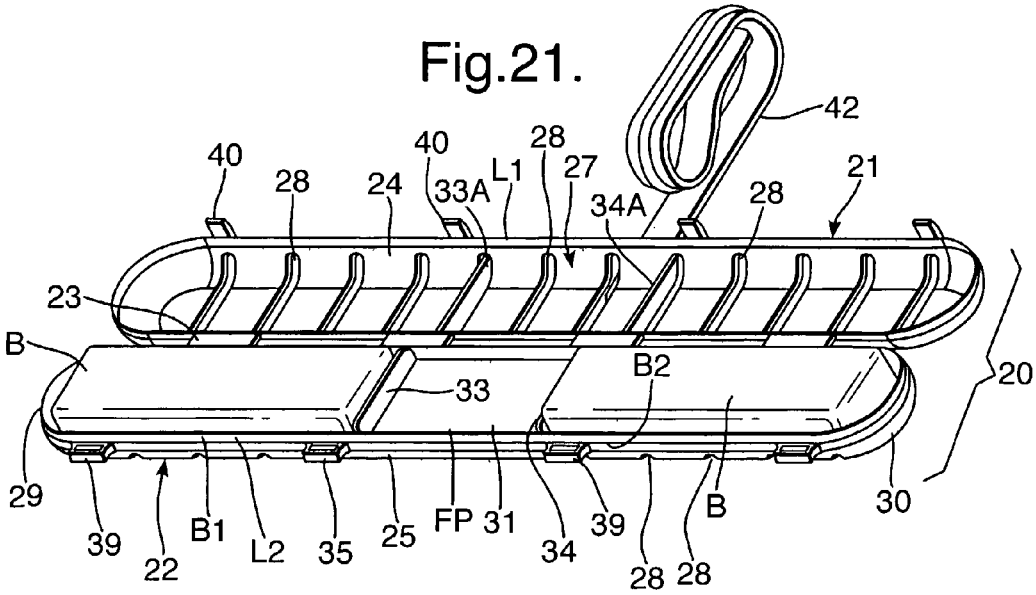
FIG. 21 illustrates a yet further embodiment of a dispenser body of a dispensing device according to the invention.

FIG. 21 illustrates a yet further embodiment of a dispenser body 20 of a dispensing device 10 according to the invention which is similar in many respects to the embodiment discussed with reference to FIGS. 1-6. According to the embodiment of FIG. 21, the dispenser body 20 comprises two parts, a front body part 21 and a back body part 22 connected by intermediate hinges 23 about which the front body part 21 and back body part 22 may be moved and fitted together to form the dispenser body 20. Each of the front body part 21 and the back body part 22 comprises a wall, respectively a front body wall 24 and a back body wall 25 which is generally arcuate in cross-sectional shape. Each of the front body wall 24 and a back body wall 25 define a body cavity 27 when the front body part 21 and a back body part 22 are fitted together. As depicted, the body cavity 27 is used to contain the chemical composition(s), and also to contain the fragrance composition of the device. In the depicted figure, the embodiment illustrates two blocks B, each of a chemical composition (which may be the same, or different from one another) nestled within the back body part 22 and positioned within the body cavity 27, as well as fragrance cavity 31 within the back body part 22 adapted to contain a quantity of a fragrance composition. As is visible from the figure, each of the front body wall 24 and a back body wall 25 comprise at least one, here a plurality of passages 28 which breach the respective front body wall 24 and a back body wall 25 and provide means for the entry of water into the dispenser body 20, as well for the egress of treatment composition from within the dispenser body 20. Also visible is that the portion of the back body part 22 containing the fragrance cavity 31 does not include passages 28 therein, which permits for the fragrance composition to be supplied directly within the back body part 22 without the need of a container or tray although such of course may be used. However the portion of the front body part 21 opposite the fragrance cavity 31 includes at least one passage 28 therethrough in order to permit for the delivery of the fragrance composition to the ambient environment of the device.

As depicted, the fragrance cavity 31 is positioned intermediate the ends 29, 30 and divides the body cavity 27 into three sections, a fragrance part FP intermediate a first body cavity B1 between the fragrance part FP and the end 29, and a second body cavity B2 between the fragrance part FP and the end 30. The fragrance part FP is physically separated from the first body cavity B1 by a barrier wall 33 spanning a part of the back body part 22. The opposite end of the fragrance part FP is physically separated from the second body cavity B2 by a further barrier wall 34 also spanning a part of the back body part 22. The front body part 21 also includes a top barrier wall 33A which spans a part of the front body part 21, and a further top barrier wall 34A which also spans a part of the front body part 21. The top barrier walls 33A, 34A configured such that, when the front body part 21 and back body parts 22 are closed upon one another, the top barrier wall 33A abuts or joins the barrier wall 33, and similarly the top barrier wall 34A abuts or joins the barrier wall 34A such that the corresponding walls provide for a physical barrier which divides the body cavity 27 into three sections and to also isolates the chemical composition(s), here in the form a blocks B from the adjacent fragrance cavity 31. As is readily understood from inspection of FIG. 21, the interior of the fragrance cavity 31 is are exposed to the ambient environment through the one or more passages 28 in the opposite body part, here front body part 21 when the two body parts 21, 22 are closed to form the dispenser body. As not depicted, the interior of each of the fragrance cavity 31 may include one or more anchor elements which depend from the back body wall 25, as described and depicted in the prior figures discussed. While such a feature is optional, the presence of one or more anchor elements provide for improved retention of a fragrance composition when such is in the form of a gel or paste.

Preferably the mating edges of the front body part 21, back body part 22 and the corresponding barrier walls 33, 34 and top barrier walls 33A, 34A are each rabbetted, such that a lapped juncture is formed when the dispenser body 20 is assembled. Such a lapped juncture is advantageously and preferably used in the various embodiments of the invention as providing good structural integrity to the closure, and good isolation of the fragrance cavity 31 from adjacent body cavities B1, B2 when the dispensing device 20 is assembled.

Each of the front body part 21 and a back body part 22 including corresponding mating means which may be used to provide a releasable or non-releasable closure of the front body part 21 and a back body part 22 in order to form the dispenser body 20. In the depiction there are provided a series of female connecting elements 39 on the back body part 22 which join with corresponding male connecting elements 40 provided on the front body part 21. While mechanical elements are herein depicted, it is to be understood that mating means may include any element or device which may be used to close the front body part 21 and a back body part 22 including but not limited to: mechanical fasteners or elements, friction fitted portions of the front body part 21 and a back body part 22, chemical materials such as adhesives, as well as welds or bonds.

The device 10 also includes a connector 41 which, in the depicted embodiment is positioned on or as part of the front body part 21. The connector is provided as a seat for an end of the hanger, a hanger 42 which is also depicted. It is to be understood however that configuration for the connector 41 is envisioned and indeed two or more connectors may be present to accommodate an appropriate hanger or plurality of hangers. The embodiment illustrated on FIG. 21 however may be used with any suitable hanger, including any of the embodiments of hangers discussed with reference to other figures.

While not depicted in FIG. 21 it is nonetheless that other variations and modifications are contemplated and are considered to fall within the scope of the present invention.

In a first alternative, the fragrance cavity 31 is formed within the front body part 21 in which case the passages 28 intermediate the top barrier walls 33A, 34A are omitted, or if not omitted, the fragrance composition is supplied in a tray or other carrier which is fittable within the fragrance cavity, while however the portion of the back body part 22 intermediate the two barrier walls 33, 34 are provided with at least one passage 28 extending therethrough which permits for the fragrance composition to be delivered to the ambient environment. Such an embodiment may be preferred in certain manufacturing and assembly processes.

In a second alternative, a single fragrance cavity 21 is provided adjacent to a single body cavity B1, or B2, and the two cavities are separated by a barrier wall.

It is to be understood that references to directions, e.g., frontwardly, rearwardly, and upwardly discussed in this specification are included for sake of convenient reference and are not to be construed as limiting of the scope of the invention.

EXAMPLES

Blocks having the compositions on the following table were produced by extruding the constituents into blocks having a size of 20 mm by 10 mm by 75 mm, which provides a block having surface area/volume ratio of 4500 $mm^2$/15000 mm, or 0.3.

TABLE 1

| | C1 | E1 | E2 | E3 | E4 | E5 | E6 | E7 | E8 | E9 | E10 | E11 | E12 |
|---|---|---|---|---|---|---|---|---|---|---|---|---|---|
| AOS | 32.0 | 27.0 | 27.0 | 15.0 | 15.0 | 15.0 | 15.0 | 23.59 | 20.18 | 15.0 | 27.0 | 27.0 | 27.0 |
| LMEA (98%) | 5.0 | 30.0 | 30.0 | 22.0 | 15.0 | 30.0 | 30.0 | 25.77 | 21.55 | 30.0 | 15.0 | 15.0 | 15.0 |
| DDBS 80% | 35.0 | 15.0 | 15.0 | 35.0 | 32.0 | 17.0 | 17.0 | 20.05 | 25.09 | 27.0 | 20.0 | 30.0 | 20.0 |
| Na Sulfate | 21.0 | 21.0 | 21.0 | 21.0 | 31.0 | 31.0 | 31.0 | 23.59 | 26.18 | 21.0 | 31.0 | 21.0 | 31.0 |
| Na lauryl ether sulfate (70%) | 5.0 | 5.0 | 5.0 | 5.0 | 5.0 | 5.0 | 5.0 | 5.0 | 5.0 | 5.0 | 5.0 | 5.0 | 5.0 |
| silica | 2.0 | 2.0 | 2.0 | 2.0 | 2.0 | 2.0 | 2.0 | 2.0 | 2.0 | 2.0 | 2.0 | 2.0 | 2.0 |

The specific identity of the constituents used to produce the blocks are described more fully in the following table:

TABLE 2

| Constituent: | Identity |
|---|---|
| AOS (95-100%) | alpha olefin sulfonate, sodium salt, 95-100% wt. actives |
| LMEA 98% | lauramide monoethanolamide, 98% wt. actives |

TABLE 2-continued

| Constituent: | Identity |
|---|---|
| DDBS (80%) | anionic surfactant, dodecylbenzene sulfonate, 80% wt. actives |
| Na sulfate | sodium sulfate, 100% wt. actives |
| Na lauryl ether sulfate (70%) | anionic surfactant, sodium lauryl ether sulfate, 70% wt. actives |
| silica | anhydrous silica, 100% wt. actives |

The performance characteristics of the blocks were evaluated by placing them into a dispensing device according to FIG. 1 and suspending the block and the device beneath the rim of a standard toilet and in the path of flush water released from the cistern. The blocks were weighed initially, and then subsequent to 24, 108, 132, 168, 216, 264 and 336 flush cycles. The weight deviation from the original block weight is reported on the following table.

TABLE 3

| | % wt. loss (−)/% wt. gain (+) | | | | | | |
|---|---|---|---|---|---|---|---|
| Flushes: | 24 | 108 | 132 | 168 | 216 | 264 | 336 |
| C1 | −5 | −35 | −48 | −68 | −90 | — | — |
| E1 | +9.7 | +2.7 | −13.6 | −41.2 | −85.1 | — | — |
| E2 | +9.3 | +15.2 | +5 | −12.6 | −53.3 | −65.5 | −80.1 |
| E3 | +9.4 | +1.1 | −9.2 | −19.7 | −56.7 | −74.5 | −88.4 |
| E4 | +5.5 | +3.2 | −5.2 | −13.6 | −32.0 | −54.1 | −69.5 |
| E5 | +7.5 | +19.2 | +16.7 | +13.1 | −3.6 | −34.2 | −87.1 |
| E7 | +5.6 | −7.3 | −22.2 | −40.6 | −67.1 | −77 | −94.2 |
| E8 | +5.3 | −9.6 | −25.9 | −50.3 | −94.2 | — | — |
| E9 | +10.5 | +16.3 | +7.7 | −0.1 | −21.6 | −37.5 | −63.9 |
| E10 | −2.2 | −31.2 | −47.3 | −62.0 | −81.4 | −85.3 | — |
| E12 | +2.7 | −41.7 | −61.0 | −76.3 | −89.0 | — | — |

As is evident from the foregoing table, certain of the block were noted to initially gain weight which is attributed to water absorption, and indicated by positive "+" percentages. Weight losses are indicated by negative "−" percentages, and where no composition was remaining in the device, such is noted by "—" in the table, signifying that the block was consumed prior to the flush cycle indicated.

The blocks were also evaluated for their foaming characteristics following use. Following the $24^{th}$ flush cycle of the foregoing test, the appearance of the foam within the interior of the toilet bowl was visually observed and evaluated, then scored. The results of this evaluation are indicated on the following table, wherein the scores were as follows:

"4"=a thick foam layer covering the complete surface of the water in the bowl;

"3"=a thinner foam layer covering the complete surface of the water in the bowl;

"2"=a foam layer incompletely covering the surface of the water in the bowl;

"1"=visible foam at the peripheral edges of the water in the bowl and the sidewall of the toilet bowl;

"0"=no visible foam on the surface of the water in the bowl. The results of this evaluation are reported on the following table.

TABLE 4

| | Foam Rating following 24 flushes |
|---|---|
| E1 | 3 |
| E2 | 2 |
| E3 | 3 |
| E4 | 3 |
| E5 | 2 |
| E7 | 3 |
| E8 | 3 |
| E9 | 3 |
| E10 | 4 |
| E12 | 3 |

As is visible from the foregoing, the blocks provided good foaming performance and long lasting performance in the dispensing devices of the invention.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A dispensing device adapted for use in a toilet bowl or other sanitary appliance which device provides for the delivery of at least one treatment composition while simultaneously optionally providing a fragrancing effect to the ambient environment of the sanitary appliance as well wherein the device includes:

(a) a dispenser body comprising a body cavity adapted to contain at least one chemical composition; at least one inlet to permit for passage of water contained within the sanitary appliance to pass into the body cavity and contact the at least one chemical composition and; at least one outlet to permit for the egress of a treatment composition from the body cavity; and at least one fragrance cavity adapted to contain a quantity of a fragrance composition;

(b) a hanger which may depend from any part of the device which hanger is adapted for removably hanging the device upon a portion of a toilet bowl or other sanitary appliance characterized in that:

the dispenser body has a maximum overall length dimension "L" and a maximum width dimension "W" measured in a plane perpendicularly intersecting "L" wherein the value of "L" to the value of "W" is at least 2×W, and, the dispenser body is sufficiently flexible such that the angle of deflection of the midpoint (M) of at least one end of the dispenser body, as measured between an original linear configuration of the dispenser body, and its deformed configuration as measured from the midpoint between two endpoints (E, F) of the dispenser body is at least 5°.

2. A dispensing device according to claim 1 comprising at least two fragrance cavities adapted to contain a quantity of a fragrance composition.

3. A dispensing device according to claim 1 wherein the hanger includes a secondary fragrance carrier.

4. A dispensing device according to claim 1 wherein the dispenser body contains at least one chemical composition in the body cavity.

5. A dispensing device according to claim 1 wherein the dispenser body contains at least two chemical compositions in the body cavity.

6. A dispensing device according to claim 1 wherein the dispenser body (20) contains at least one chemical composition in the body cavity, and further contains a fragrance composition within the fragrance cavity (31, 32).

7. A dispensing device according to claim 1 wherein the dispensing device contains a cleaning block comprises:

10-35% wt. of an alpha olefin sulfonate anionic surfactant;

10-35% wt. of a linear monoethanolamide;

5-50% wt. of a linear dodecylbenzene sulfonate anionic surfactant;

5-50% wt. of sodium sulfate 0.1-15% wt. of silica 0.1-25% wt. sodium lauryl ether sulfate optionally to 40% wt. further additive constituents, including further surfactants, fillers, binders, fragrances, processing aids such as lubricants and tabletting aids, bleaches, and sanitizing compositions.

8. A process for the delivery of at least one treatment composition to the interior of a sanitary appliance, or toilet bowl, which process contemplates providing a dispensing device according to claim 1, installing the device within or upon at least a portion of a sanitary appliance, or toilet bowl, such that the at least one chemical composition contained within the dispensing device contacts water and forms a treatment composition used for treating the sanitary appliance, while optionally but desirably simultaneously providing a fragrancing effect to ambient environment of the sanitary appliance or toilet bowl.

9. A dispensing device according to claim 1 wherein the at least one treatment composition selected from: coloring compositions, cleaning compositions, bleaching compositions and disinfecting compositions, and anti-limescale compositions.

10. A dispensing device according to claim 1 wherein the at least one chemical composition is selected from: coloring compositions, cleaning compositions, bleaching compositions and disinfecting compositions, and anti-limescale compositions.

11. A dispensing device according to claim 1 wherein the value of "L" to the value of "W" is at least is at least 2.5×W, yet more is at least 3×W, still more preferably is at least 3.5×W, especially preferably is at least is at least 4×W, yet more preferably is at least 4.5×W, still more preferably is at least 5×W, and most preferably is at least 7×W.

12. A dispensing device according to claim 11 wherein the value of "L" to the value of "W" is at least is at least 3×W.

13. A dispensing device according to claim 12 wherein the value of "L" to the value of "W" is at least is at least 3.5×W.

14. A dispensing device according to claim 13 wherein the value of "L" to the value of "W" is at least is at least 4×W.

15. A dispensing device according to claim 14 wherein the value of "L" to the value of "W" is at least is at least 4.5×W.

16. A dispensing device according to claim 15 wherein the value of "L" to the value of "W" is at least is at least 5×W.

17. A dispensing device according to claim 1 wherein the value of "L" to the value of "W" is at least is at least 7×W.

* * * * *